US009421672B2

(12) United States Patent
Rowlay et al.

(10) Patent No.: US 9,421,672 B2
(45) Date of Patent: Aug. 23, 2016

(54) CLAMP ASSEMBLY

(71) Applicants: Stephen Rowlay, Sheffield (GB); Robert Christie, South Glastonbury, CT (US); James Spaulding, Bristol, CT (US); Karl Vanderbeek, Germantown, OH (US); Nidta Viyakornvilas, West Hartford, CT (US)

(72) Inventors: Stephen Rowlay, Sheffield (GB); Robert Christie, South Glastonbury, CT (US); James Spaulding, Bristol, CT (US); Karl Vanderbeek, Germantown, OH (US); Nidta Viyakornvilas, West Hartford, CT (US)

(73) Assignee: STANLEY BLACK & DECKER, INC., New Britain, CT (US)

( * ) Notice: Subject to any disclaimer, the term of this patent is extended or adjusted under 35 U.S.C. 154(b) by 730 days.

(21) Appl. No.: 13/687,640

(22) Filed: Nov. 28, 2012

(65) Prior Publication Data

US 2014/0145389 A1 May 29, 2014

(51) Int. Cl.

*B25B 5/00* (2006.01)
*B25B 5/16* (2006.01)
*B25B 5/10* (2006.01)

(52) U.S. Cl.

CPC ..... *B25B 5/006* (2013.01); *B25B 5/003* (2013.01); *B25B 5/10* (2013.01); *B25B 5/16* (2013.01); *B25B 5/166* (2013.01); *Y10T 29/49819* (2015.01)

(58) Field of Classification Search

CPC ..... B25B 5/06; B25B 5/04; B25B 5/006; B25B 5/16; B25B 5/068

See application file for complete search history.

(56) References Cited

U.S. PATENT DOCUMENTS

| | | | | |
|---|---|---|---|---|
| 359,942 | A * | 3/1887 | Shaw | B25B 5/102 269/139 |
| 932,516 | A | 8/1909 | Todd | |
| 1,452,164 | A | 4/1923 | Margelis | |
| 1,998,597 | A * | 4/1935 | Stuart | 269/89 |

(Continued)

FOREIGN PATENT DOCUMENTS

| | | |
|---|---|---|
| DE | 1 869 850 U | 4/1963 |
| DE | 73 13 361 | 8/1973 |

(Continued)

OTHER PUBLICATIONS

Clamp Head—TM130. [online] Irwin Industrial Tools, 2012 [retrieved on Sep. 11, 2012]. Retrieved from the Internet: <URL: http://www.farnell.com/datasheets/60588.pdf via http://www.au.element14.com/irwin-record/tm130/clamp-head/dp/1568303>.

*Primary Examiner* — Monica Carter
*Assistant Examiner* — Seahee Yoon
(74) *Attorney, Agent, or Firm* — Pillsbury Winthrop Shaw Pittman LLP

(57) ABSTRACT

A clamp assembly that can be installed on and removed from its mounting on an elongated structure (e.g., 2×4) without the need for sliding past an end of the structure is disclosed. The clamp assembly may include a pair of clamp bodies with pads for engaging a workpiece. Each of the clamp bodies includes a clamp mount with a movable member arranged to be moved into forced engagement with an exterior surface (e.g., side) of the 2×4 to fix the clamp body on the 2×4. At least one of or both of the clamp bodies include a releasable connection that, when released, allows for the removal of the clamp body from the 2×4 without the need to longitudinally slide the body past an end of the 2×4.

16 Claims, 19 Drawing Sheets

(56) References Cited

U.S. PATENT DOCUMENTS

| | | | | |
|---|---|---|---|---|
| 3,249,351 | A | 5/1966 | Smith | |
| 4,096,065 | A | 6/1978 | Bruch et al. | |
| 4,900,183 | A * | 2/1990 | Souchko | 403/385 |
| 5,427,465 | A * | 6/1995 | Sato | 403/49 |
| 5,568,915 | A | 10/1996 | Raymond | |
| 5,673,888 | A | 10/1997 | Garguilo | |
| 5,947,424 | A | 9/1999 | Heath | |
| 6,067,693 | A | 5/2000 | Chen | |
| 6,237,890 | B1 | 5/2001 | Gates | |
| 6,443,441 | B1 | 9/2002 | Buitenhuis | |
| 7,131,643 | B1 | 11/2006 | Sankey, II | |
| 7,374,158 | B2 | 5/2008 | Deming | |
| 2004/0144903 | A1 | 7/2004 | Cherubini et al. | |
| 2010/0117281 | A1 | 5/2010 | Doyle | |

FOREIGN PATENT DOCUMENTS

| | | |
|---|---|---|
| DE | 25 54 495 | 6/1977 |
| DE | 43 04 992 | 9/1993 |
| DE | 198 13 879 | 10/1999 |
| DE | 200 12 231 | 12/2000 |
| DE | 201 02 933 | 5/2001 |
| DE | 201 06 671 | 7/2001 |
| DE | 203 06 572 | 6/2003 |
| DE | 103 12 316 | 9/2004 |
| EP | 0 274 746 | 7/1988 |
| EP | 0 728 058 B1 | 3/2002 |
| EP | 1 584 413 | 10/2005 |
| GB | 1 323 703 | 7/1973 |

* cited by examiner

CLAMP ASSEMBLY

BACKGROUND

1. Field

The present disclosure is generally related to the field of tools, and, more specifically, to a clamp assembly.

2. Description of Related Art

A clamp is a device used to join, grip, support, or compress mechanical or structural parts. Clamps use opposing, sometimes adjustable sides or parts for bracing objects or holding them together. Generally, a clamp is used by positioning a jaw or jaws of the clamp on surfaces of a workpiece to be clamped. The workpiece is any member or members that needs clamping. For example, the workpiece may be two elements that are being joined together by adhesive or otherwise and require a clamping force.

The present invention provides improvements over prior art clamps.

SUMMARY

One aspect of the disclosure provides a clamp assembly including: a clamp body configured to engage an elongated structure on which the clamp assembly is to be mounted and a workpiece engaging head connected with the clamp body. The clamp body includes a movable member arranged to be moved into forced engagement with an exterior surface of the elongated structure to fix the clamp body on the elongated structure. The movable member is movable away from said forced engagement to allow the clamp body to be loosened from the elongated structure. The clamp body has a releasable connection constructed and arranged to be released so that the clamp assembly can be installed on and released from the elongated structure without requiring the clamp body to be longitudinally slid past an end of the elongated structure.

Another aspect of the disclosure provides a clamp assembly pair including: a first clamp body and a second clamp body. The first clamp body is configured to engage an elongated structure on which the clamp assembly pair is to be mounted. The first clamp body includes a first workpiece engaging head connected with the first clamp body and a first movable member arranged to be moved into forced engagement with an exterior surface of the elongated structure to fix the first clamp body on the elongated structure. The first movable member is movable away from said forced engagement to allow the first clamp body to be loosened from the elongated structure. The second clamp body is also configured to engage an elongated structure on which the clamp assembly pair is to be mounted. The second clamp body includes a second workpiece engaging head connected with the second clamp body and a second movable member arranged to be moved into forced engagement with the exterior surface of the elongated structure to fix the second clamp body on the elongated structure in spaced relation relative to the first clamp body. The second movable member is movable away from said forced engagement to allow the second clamp body to be loosened from the elongated structure. At least one of the first clamp body and the second clamp body has a releasable connection constructed and arranged to be released so that the clamp assembly can be installed on and released from the elongated structure without requiring the clamp body to be longitudinally slid past an end of the elongated structure.

Yet another aspect of the disclosure provides a method for releasing a clamp assembly from an elongated structure. The clamp assembly includes: a clamp body configured to engage the elongated structure on which the clamp assembly is to be mounted, a workpiece engaging head connected with the clamp body, and a movable member arranged to be moved into forced engagement with an exterior surface of the elongated structure to fix the clamp body on the longitudinal wood structure. The movable member is movable away from said forced engagement to allow the clamp body to be loosened from the elongated structure. The clamp body has a releasable connection constructed and arranged to be released so that the clamp assembly can be released from the elongated structure. The method for releasing includes: moving the movable member away from said forced engagement with the exterior surface of the elongated structure; releasing the releasable connection, and removing the clamp body from the elongated structure without requiring the clamp body to be longitudinally slid past an end of the elongated structure.

Other features and advantages of the present disclosure will become apparent from the following detailed description, the accompanying drawings, and the appended claims.

DETAILED DESCRIPTION

Figure 1:
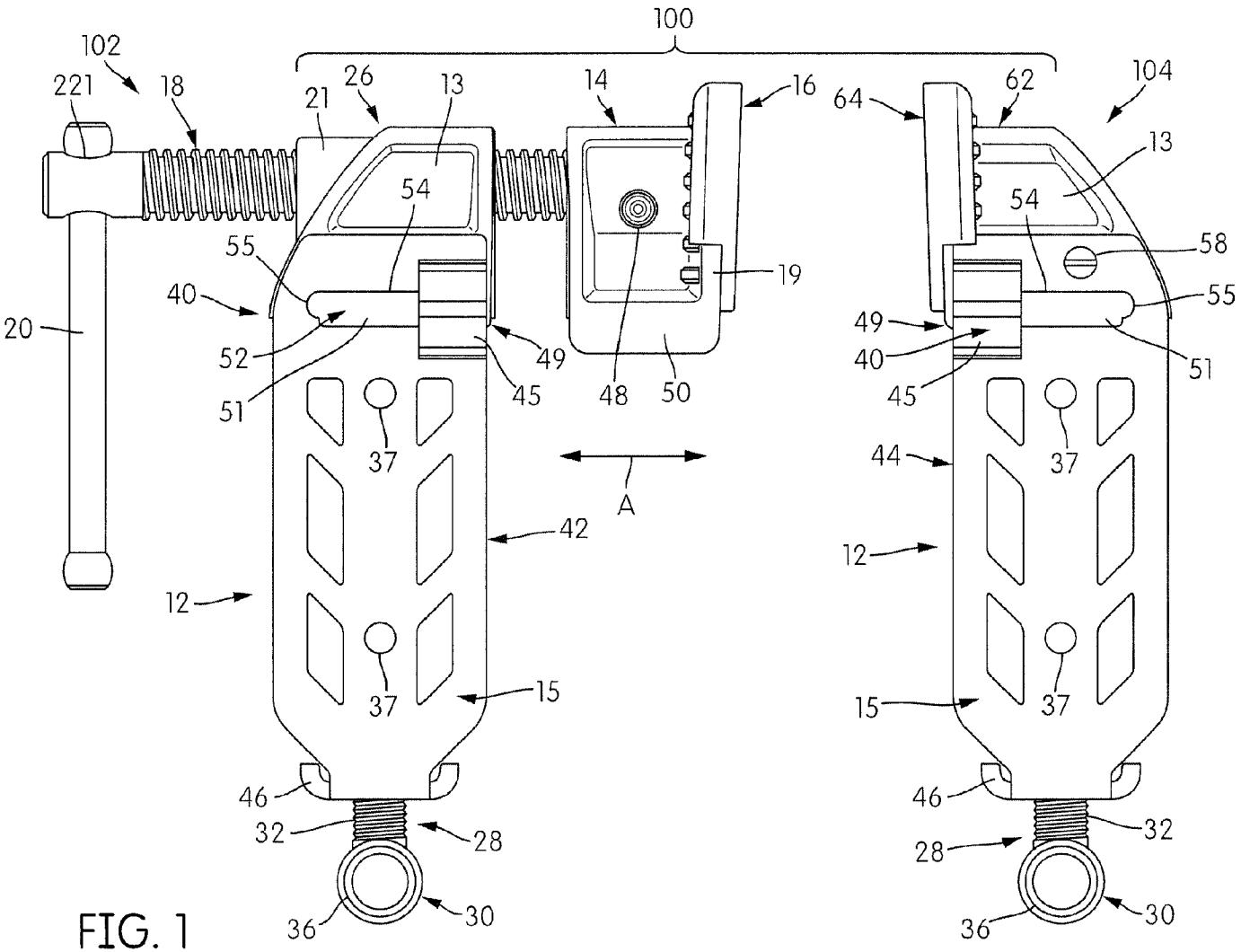
FIG. 1 illustrates a side view of a clamp assembly pair in accordance with an embodiment of this disclosure.
Figure 2:
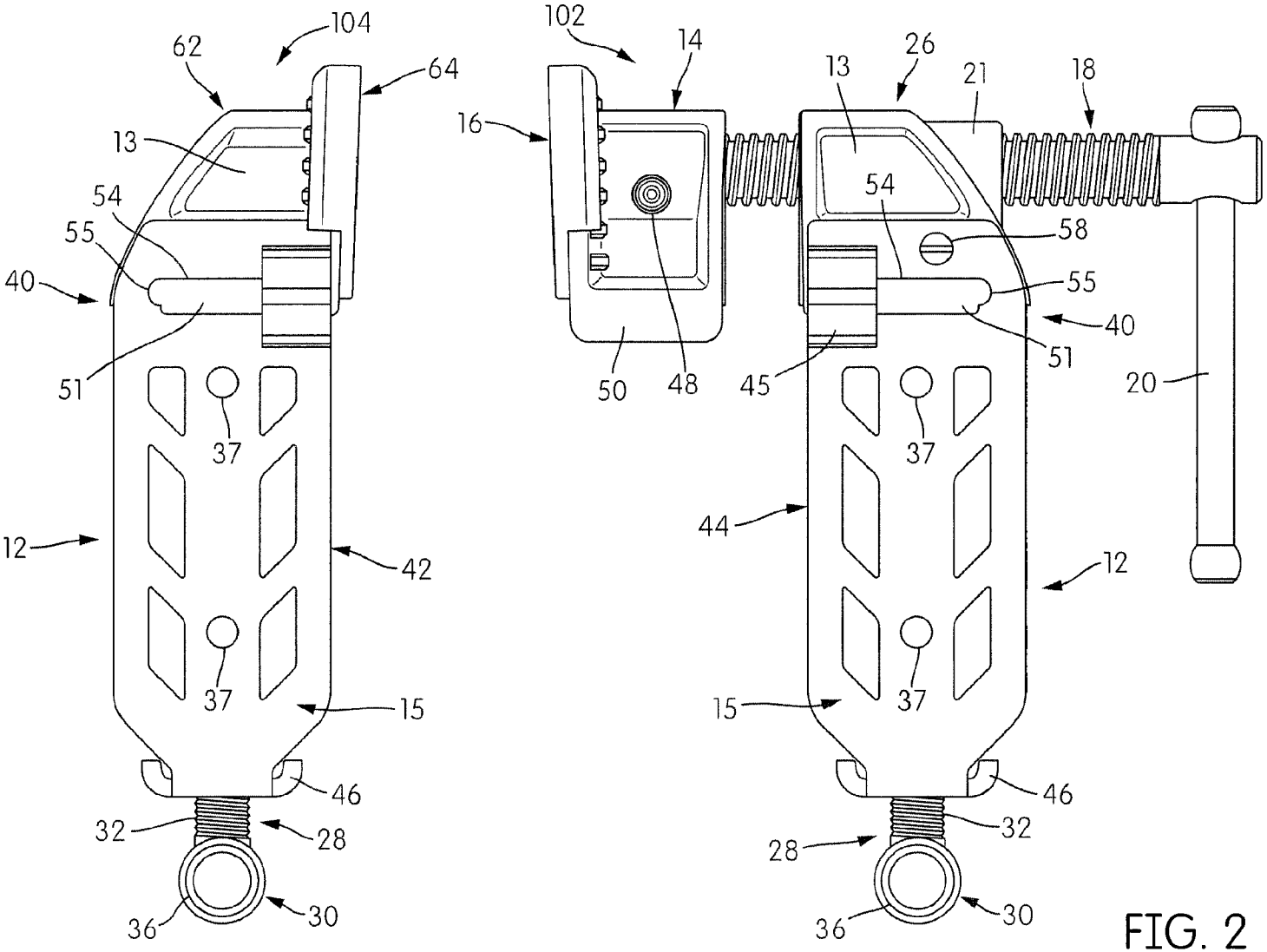
FIG. 2 illustrates an opposite side view of the clamp assembly pair of FIG. 1.
Figure 3:
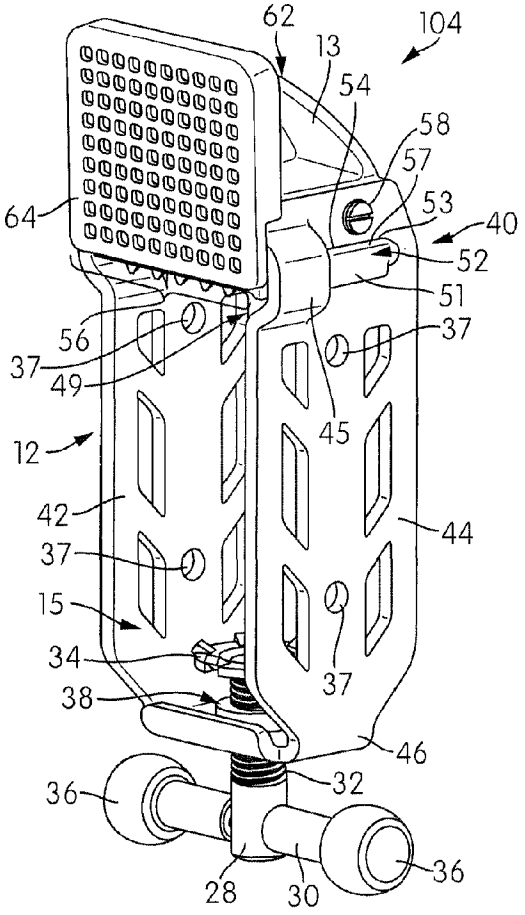
FIG. 3 illustrates a perspective view of the clamp assembly pair of FIG. 1.
Figure 3:
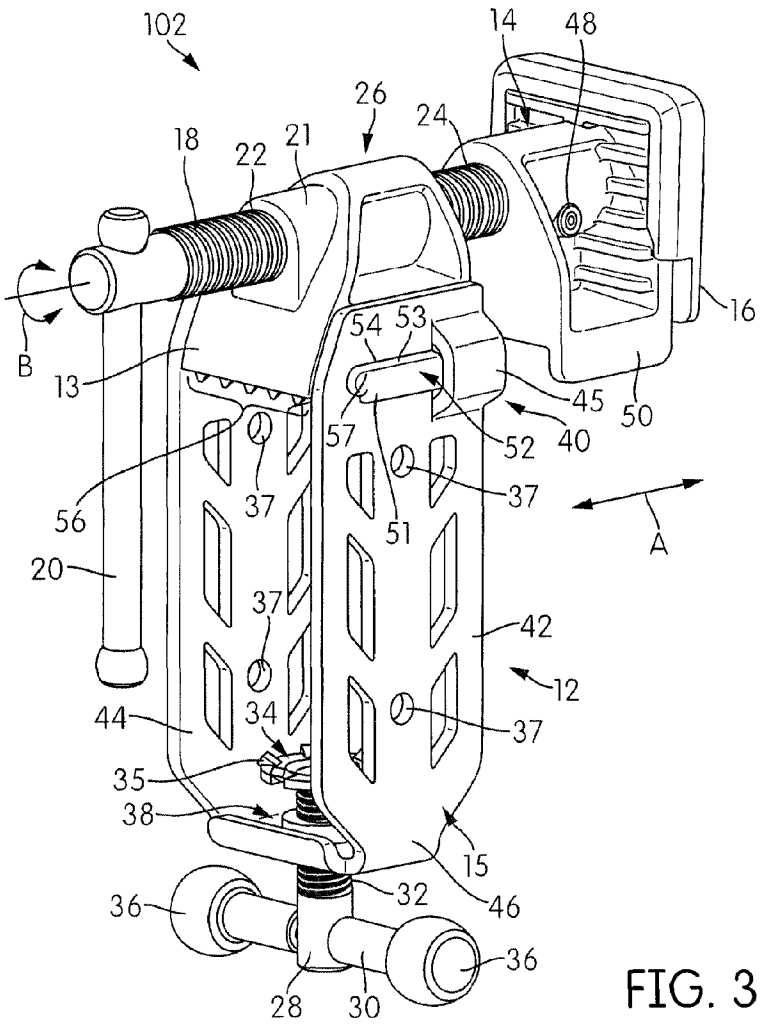
Figure 9:
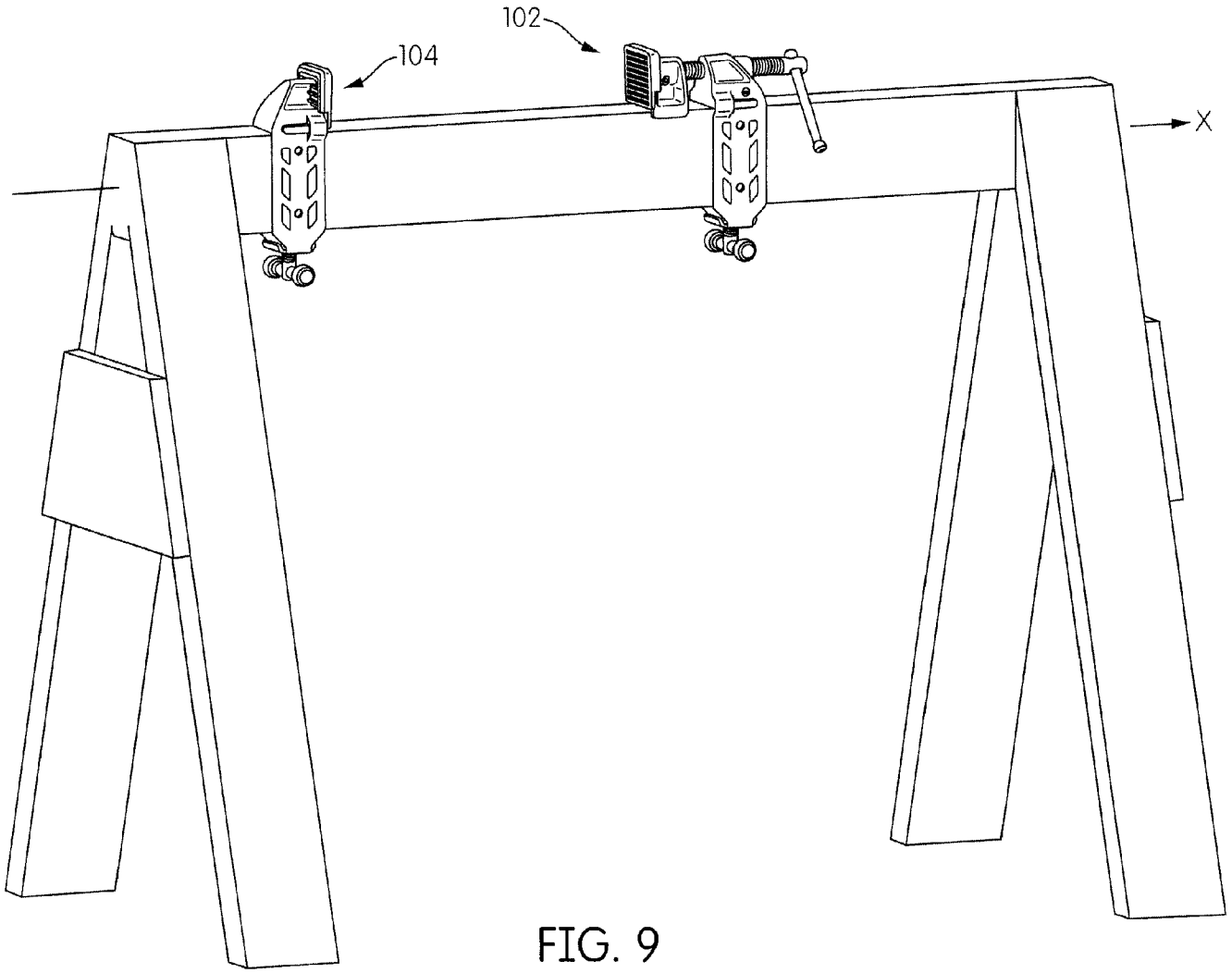
FIG. 9 illustrates the clamp assembly pair of FIG. 1 mounted on a 2×4 wood structure of a saw horse in accordance with an embodiment.

FIGS. 1-3 illustrate a clamp assembly pair 100 in accordance with an embodiment of this disclosure. The use of each clamp assembly as a pair 100 is described herein with reference to it being mounted on an elongated structural member 200 (see FIG. 4). In one embodiment, the elongated structure can be a 2×4 wood structure (note that the actual dimensions of what is nominally a 2×4 wood structure is actually approximately 1.5"×3.5", with some degree of tolerance; for the purposes of this disclosure, a 2×4 wood structure or member can have a cross-sectional dimension of between 1⅜" to 1⅝" by 3⅜" by 3⅝"). It should be appreciated, however, that other elongated structures to which the clamp assembly pair 100 can be mounted are also contemplated. For example, wood members of other dimensions can be used. In addition, I-beams, metal pipes, or the like can also be used. For simplicity purposes, the clamp assembly pair 100 is illustrated in the figures as mounted on 2×4 wood member. In one embodiment, the 2×4 wood structure may be provided as part of or integrated into another structure. For example, FIG. 9 illustrates an embodiment wherein the 2×4 wood structure for mounting the clamp assembly thereon is part of a saw horse. The 2×4 may be part of another structure, including, but not limited to, rafters or framing for a house. Throughout this disclosure, a 2×4 wood structure may be simply referred to as a "2×4" or a "wood structure." A "workpiece" is one or more pieces of material(s) that are configured to be clamped and held between the two clamp assemblies 102 and 104 of the clamp assembly pair 100.

Referring back to FIGS. 1 and 3, clamp assembly pair 100 comprises a first clamp assembly 102 (on the left side in FIGS. 1 and 3) and a second clamp assembly 104 (on the right side in FIGS. 1 and 3). The first clamp assembly 102 includes a first clamp body 12 and a first workpiece engaging head 14. First clamp body 12 comprises an upper portion 13 and a lower portion 15 and is configured to engage an elongated structure on which first clamp assembly 102 is to be mounted.

First workpiece engaging head 14 is connected with first clamp body 12. More specifically, the first workpiece engaging head 14 of first clamp assembly 102 is an adjustable clamp head. In this embodiment, the adjustable clamp head 14 is connected to the body 12 by a threaded adjustment screw 18. Adjustable clamp head 14 is configured to move or slide in a longitudinal direction (relative to the elongated structure 200 on which the clamp assembly 102 may be mounted) by rotation of the screw 18. An overhanging lip (or lips) 50 extending downwardly from a side of head 14 acts as a guide for movement of the head 14 along the wood structure as will be described in more detail later. It should be appreciated that in one embodiment a lip 50 may be provided on both opposite sides of head 14 so that the head 14 in essence straddles the elongated structure 200. Adjustable clamp head 14 is moved relative to a fixed or anchored workpiece engaging clamp head 62 that is provided by the second clamp assembly 104. Adjustable clamp head 14 can move in a direction as indicated by arrow A, to allow clamping or releasing of a workpiece between the clamping surfaces of the first clamp assembly 102 and the second clamp assembly 104.

In an embodiment, adjustable clamp head 14 includes an optional first workpiece engaging pad 16. Pad 16 provides a surface for engaging a workpiece. In one embodiment, pad 16 is removable and replaceable. In an exemplary non-limiting embodiment, the pad is formed from an elastomer or rubber material that is attached to a flange portion 19 of the adjustable clamp head 14. A surface of the pad can be formed from a resilient material that provides friction for griping a workpiece. In another embodiment, pad 16 is simply an integrally formed portion of adjustable clamp head 14 and can be formed from a metal material (here the pad is simply any engagement surface of the head, or can also be considered as an elimination of the pad).

As noted above, adjustable clamp head 14 is advanced or retracted relative to first clamp body 12 in a direction noted by arrow A by rotation of the screw 18 via a crank handle 20. The crank handle 20 has bulged opposite ends and is slidingly received in an opening 221 in the screw 18. First clamp body 12 has an internally threaded cylindrical nut 21 for receipt of screw 18 therethrough. One end of screw 18 is rotatably connected within adjustable clamp head 14 for movement thereof, while the other end is used to initiate rotation and movement of the adjustable clamp head 14, e.g., via a crank handle 20 mounted thereon. As an example, rotatably connected end of screw 18 is rotatable with respect to head 14, yet axially fixed to head 14. The screw 18 may be rotatably connected to the head 14 by, for example, one or more fasteners 48 inserted into head 14. In an exemplary embodiment, screw 18 comprises an annular groove (not shown) configured to receive an exterior surface of the shank of fastener 48, which construction axially fixes the head to the screw 18, but allows relative rotation therebetween.

When made to revolve about its longitudinal axis, e.g., in a rotational direction as indicated by arrow B (see FIG. 3) by crank handle 20, screw 18 will move relative to the first clamp body 12, and, thus, adjustable clamp head 14 will also move longitudinally relative to the second clamp assembly 104 when the clamp assemblies are mounted on the elongated structure 200. For example, adjustable clamping head 14 is movable towards a workpiece, and an anchored clamping head 62 of second clamp assembly 104, by turning and rotating crank handle 20 in a clockwise direction, and selectively away from the workpiece and anchored clamping head 62 by turning and rotating crank handle 20 in a counter-clockwise direction.

As also shown in FIG. 3, upper portion 13 of first clamp body 12 may include teeth 56 to securely mount the body 12 and substantially prevent movement of first clamp body 12 relative to the elongated structure (e.g., 2×4 wood structure) after the first clamp body 12 is mounted thereon.

In one embodiment, the upper portion 13 of first clamp body 12 comprises a clamp mount structure 26 that is separately formed from, and connected to, the structure forming the lower portion 15 of body 12, as will be appreciated from further discussions below. It should be appreciated, however, that in another embodiment the upper portion 13 can have a least a portion thereof integrally formed with the lower portion 15.

Clamp mount structure 26 may be formed as a body with the aforementioned internally threaded cylindrical nut 21 therethrough and the teeth 56 on an underside surface thereof. Clamp mount structure 26 is fixed relative to adjustable head 14.

First clamp body 12 also has a first movable member 28 associated with its lower portion 15. First movable member 28 is arranged to be moved into forced engagement with an exterior surface (e.g., such as the bottom side surface) of the elongated structure 200 to fix first clamp body 12 on the elongated structure, and arranged to be moved away from such forced engagement to allow first clamp body 12 to be loosened from the elongated structure. For example, first movable member 28 may be configured to move in a vertical direction relative to a wood 2×4 such that it can be engaged or disengaged with a bottom side surface of the 2×4. First movable member 28 can have a contact portion 34 on one end thereof (see FIG. 3) for contact with the 2×4. When first movable member 28 is moved into forced engagement with 2×4, contact portion 34 is engaged with an exterior surface of the wood structure.

In accordance with an embodiment, rotational movement of first movable member 28 moves contact portion 34 in a vertical direction towards or away from a 2×4. For example, first movable member 28 can be moved relative to the bottom or lower portion 15 of the body 12. Specifically, in one embodiment, the lower portion 15 of body 12 includes a base 46 and opposing side members or brackets 42, 44. In an embodiment, base 46 is integrally formed with the side members 42 and 44. Base 46 includes a through hole portion 38 through which first movable member 28 extends. First movable member 28 has screw threads 32 that cooperate with corresponding threads in through hole portion 38 so that contact portion 34 is moved into or out of engagement with the 2×4.

In an embodiment, a handle 30 is mounted on or with another end of first movable member 28 to initiate rotational movement thereof and movement of contact portion 34. Handle 30 may have a stand off foot 36 (see FIG. 3) at either of its ends to improve grip thereof.

Figure 6:
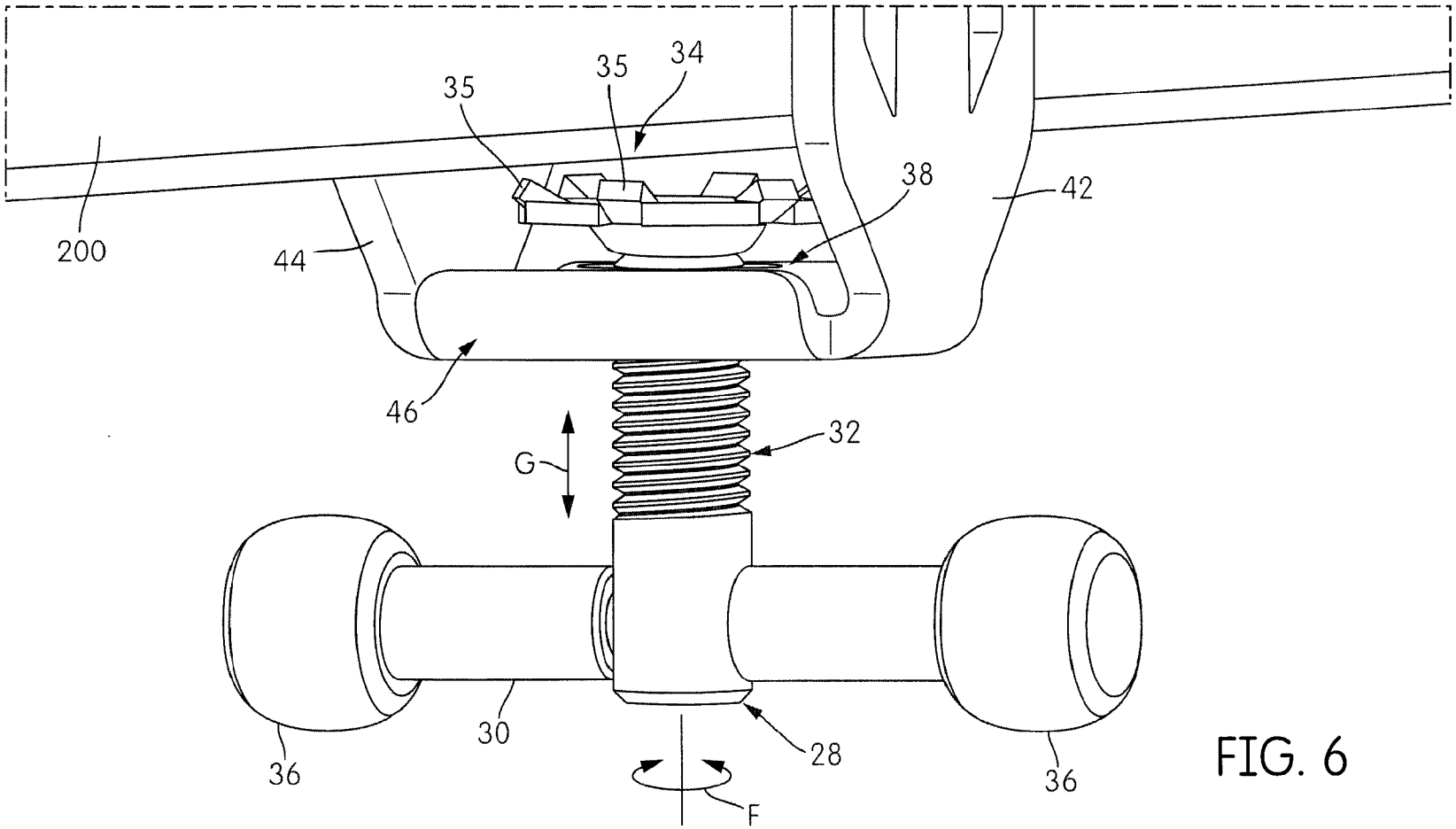
FIG. 6 illustrates a detailed, perspective view of a movable member of a clamp assembly in accordance with an embodiment of this disclosure.

In one embodiment, contact portion 34 can include a plurality of extended engagement portions or teeth 35 configured for contact with elongated structure 200. FIG. 6 is an enlarged view of the lower portion 15 of the second clamp assembly 104, and, more specifically, illustrates an example of such engagement portions or teeth 35 associated with a contact portion 34 of a movable member 28 of the second clamp assembly 104.

Each of the first clamp assembly 102 and the second clamp assembly 104 has at least one releasable connection that is constructed and arranged to be released so that the clamp assembly can be installed on and released from the elongated structure 200 without requiring the relative clamp body to be longitudinally slid over or past an end of the elongated structure. For example, in one embodiment, and as will be described in greater detail later, the first clamp assembly 102 has a releasable connection 40 that is constructed and arranged for attachment and release of first clamp body 12 with a 2×4.

In an embodiment, the releasable connection is provided between upper portion 13 and lower portion 15 of first clamp body 12. For example, in one embodiment, the releasable connection can be provided anywhere between clamp mount structure 26 and first movable member 28 (and its associated lower portion 15).

In one embodiment, as shown in FIGS. 2 and 3, releasable connection 40 is provided towards the upper portion 13 of first clamp body 12 and can be used to connect the upper portion 13 and lower portion 15. For example, first clamp body 12 may employ portions of its side members 42 and 44 to be connected with the upper portion 13 or clamp mount structure 26. As shown, in this embodiment, the clamp body 12 will surround an elongated structure 200 when the connection 40 operates to connect the upper and lower portions 13, 15. In the illustrated exemplary embodiment of FIG. 3, the brackets or side members 42 and 44 of body 12 may also be considered or viewed as a first connector 42 and second connector 44 to connect the movable member 28 (and base 46) to the clamp mount structure 26. In one embodiment, an end of each of the side members 42, 44 is integrally formed with base 46 on lower portion 15 of first clamp body 12. Each bracket or side member 42 and 44 can extend substantially vertically (or substantially perpendicularly) from base 46.

FIG. 6 shows an example of such features with reference to parts of the second clamp assembly 104 (described further below). Specifically, FIG. 6 shows side members 42 and 44 connected to the base 46. In one embodiment, the side members 42, 44 and base are integrally formed. The structure of base 46 and side members 42 and 44 can be manufactured via stamping, forging, and/or threading processes, for example.

Figure 4:
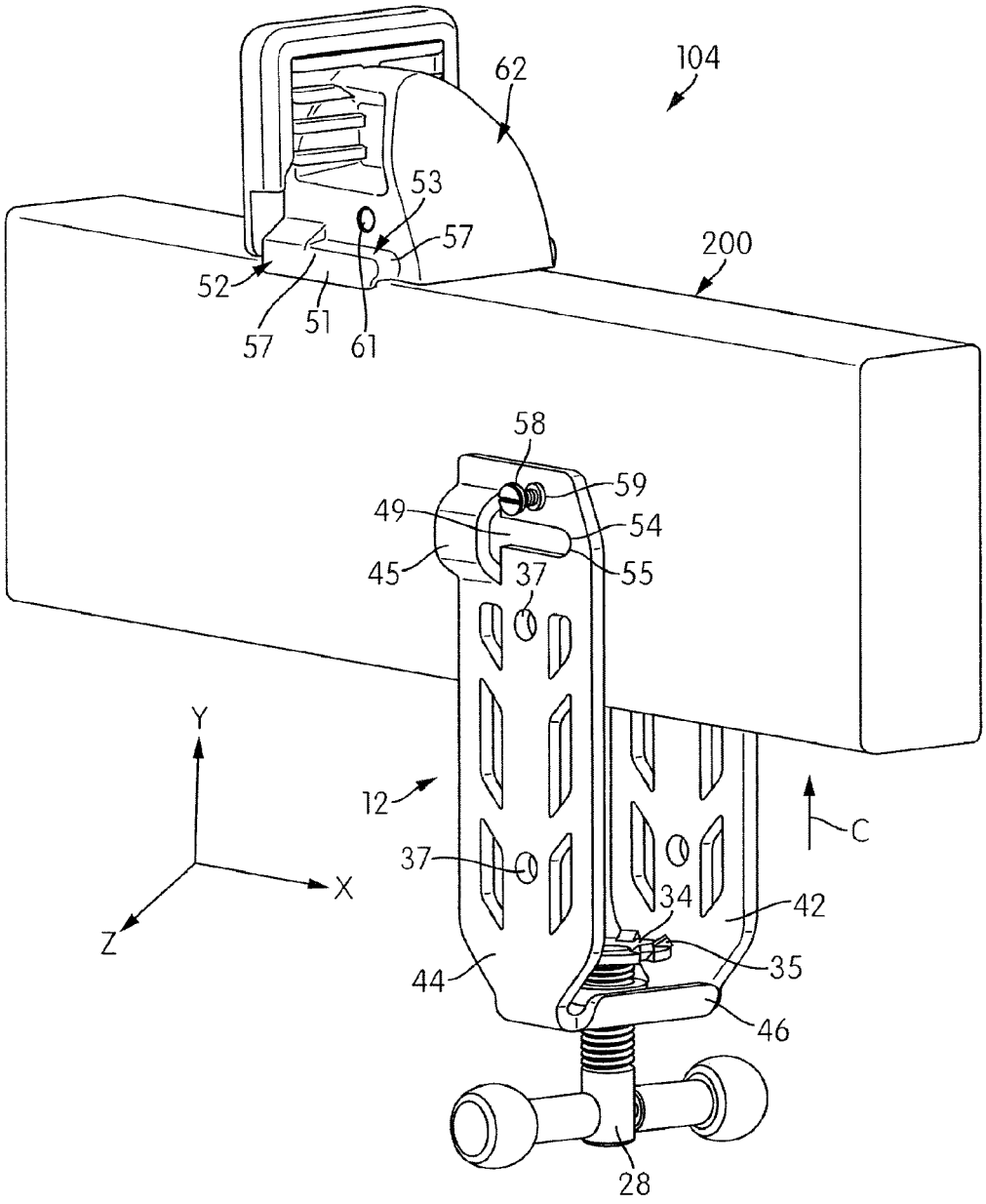
FIGS. 4 and 5 illustrate perspective views of steps for attaching a clamp body of the pair of FIG. 1 to an elongated structure.
Figure 5:
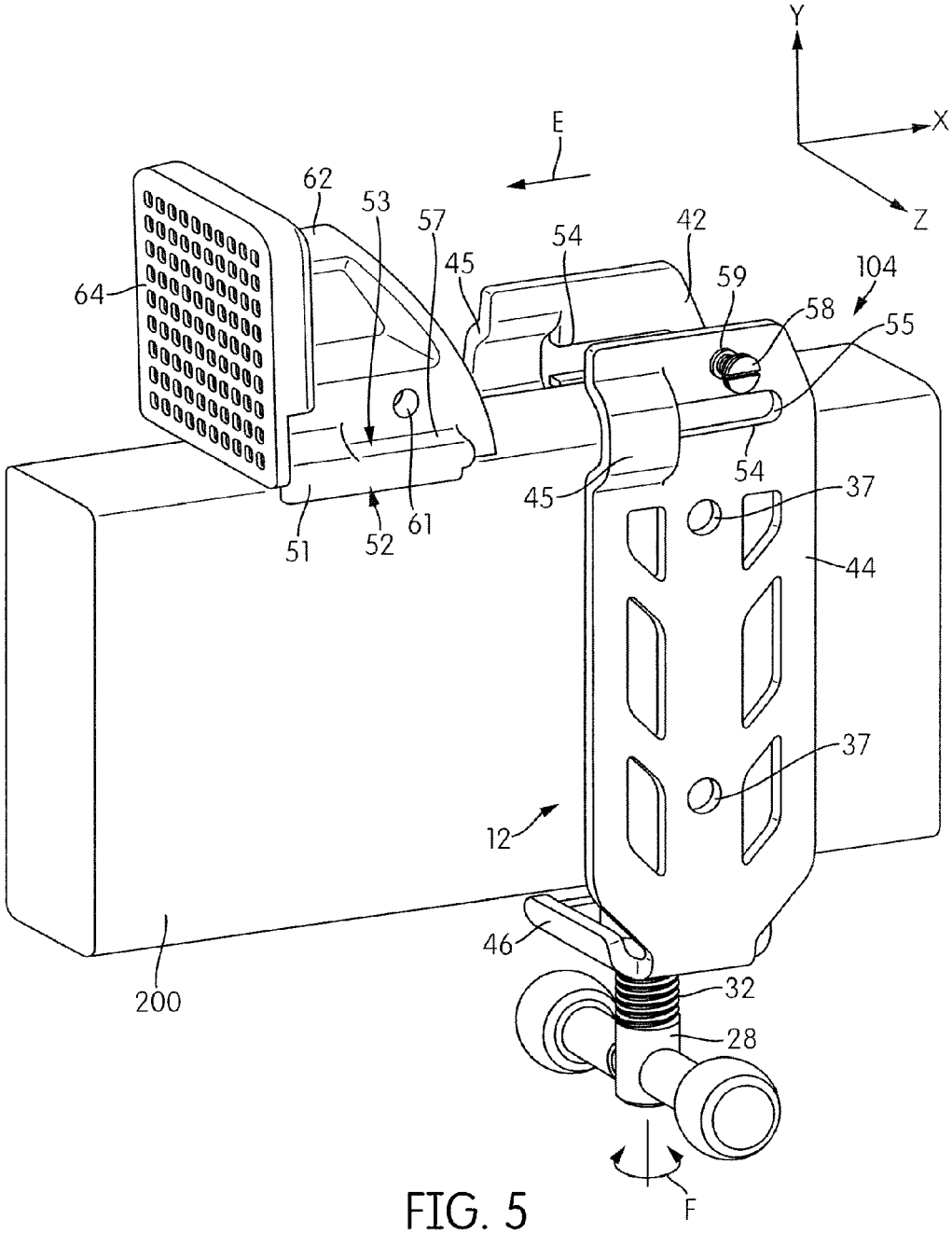

At least one portion of each of the side members 42 and 44 has a connector portion that is engagable and disengagable. Side members 42 and 44 can be configured for connection and disconnection with clamp mount structure 26, for example. In one embodiment, clamp mount structure 26 includes bracket attachment portions 52 on either of its sides for releasable connection with side members 42 and 44. Each bracket attachment portion 52 includes a protruding body 51 with a channel 53 and at least one flange 57 on an outer edge of the protruding body 51. This arrangement may be better appreciated with respect to FIGS. 4 and 5, illustrating a similar connection in the second clamp assembly 104 as will be appreciated by those skilled in the art. In one embodiment, flanges 57 are provided on opposing sides of each channel 53. Channel 53 is provided to receive a portion of a bracket or a side member therein. Each flange 57 is configured to assist in maintaining receipt of a portion of the side member within the channel 53.

Specifically, each side member 42 and 44 can have a releasable connection opening 54 on an upper portion thereof. The releasable connection opening 54 on each side member is configured for receipt of a respective one of the bracket attachment portions 52 on opposite sides of the clamp mount structure 26. More specifically, the upper edge of each releasable connection opening 54 is configured for receipt within the channel 53 of a respective protruding body 51.

In one embodiment, the connection openings 54 are effectively slots with open ends 49 that receive the protruding bodies 51. The slots 54 also have closed ends 55. In one embodiment, the brackets or side members 42, 44 can also be provided with support structures 45. Specifically, each support structure 45 may be connected both above and below the open end 49 of the slot 54 so as to structurally support the side members 42, 44 at that region and to compensate for the material removal required to create the open end 49 of the slot 54. This slot and support structure are also illustrated more clearly in the embodiment of FIG. 4, using the same reference numerals 49 and 45. Each support structure 45 may be configured to allow receipt of protruding body 51 within releasable connection opening 54. More specifically, each support structure 45 is configured to bulge outwardly from each respective side member 42 and 44 to accommodate protruding body 51 of bracket attachment portion 52 and to allow protruding body 51 to be slidingly received within the releasable connection opening (being a slot in this embodiment) 54. In the embodiment shown in FIGS. 4-6, the slot openings 49 in side members 42 and 44 are configured to be aligned with and slid into engagement with protruding bodies 51 (or vice versa). The protruding bodies 51 on either side of clamp mount structure 26 are guided by channels 53 for receipt of the edges surrounding openings 54. Flanges 57 of each protruding body 51 are provided to retain at least upper edges of the releasable connection openings 54 within channels 53 when the side members 42 and 44 are connected. In an embodiment, flanges 57 are configured to assist in maintaining connection of side members 42 and 44 with the body of clamp mount structure 26. It should be appreciated that the upper edges of the openings 54 are forcibly maintained in channels 53 when the movable member 28 is tightened against an elongated member 200 when mounted thereon.

While the attachment portions(s) 52 and opening(s) 54 provide one form of connection 40, it should be appreciated that numerous different types and forms of connections can be provided. For example, the projection can be provided on the side members and openings and/or slots provided in the clamp mount structure 26. Also, rather than a projection/opening, various types of fasteners can be used to form the connection 40.

In accordance with one embodiment, rather than a slot, the openings 54 are closed at both ends, and no support structure 45 is provided. Side members 42 and 44 may be forced into connection with clamp mount structure 26. For example, a user may position side members 42 and 44 around elongated structure 200 near clamp mount structure 26. A user may apply force to bend the side members slightly outwardly away from the clamp mount structure 26 to allow receipt of bracket attachment portions 52 (protruding bodies 51) in releasable connection openings 54. Shape memory spring force may return side members 42 and 44 to their original configurations.

Once bracket attachment portions 52 on both sides are received within their respective openings 54, the side members 42 and 44 may optionally be secured via at least one thumb screw 58. Specifically, an opening 61 (an example being shown with reference to a second clamp body 12 in FIG. 4) for attachment of a thumb screw 58 or other fastening device is provided on one or both sides of first clamp body 12. The opening 61 may be an internally threaded alignment opening or a non-threaded hole, for example. In one embodiment, opening 61 is provided in clamp mount structure 26. A corresponding receiving opening 59 can be provided in one or more of the side members 42 and/or 44. In one embodiment, the receiving opening 59 is threaded. Receipt of each bracket attachment portion 52 within opening 54 can align receiving opening(s) 59 of the side member(s) 42 and/or 44 with the opening(s) 61. In an embodiment, thumb screw 58 is associated with either one of the side member 42 or 44. Thumb screw 58 is configured to be moved and tightened in a rotational direction such that side members 42 and 44 are connected to and secured with respect to the clamp mount structure 26. Tightening of thumb screw 58 on one side can force both side members 42 and 44 into engagement and connection with clamp mount structure 26. Movement of thumb screw 58 in an opposite rotational direction (to the rotational direction for tightening the screw 58) can alternatively loosen the connection between side members 42 and 44 and clamp mount structure 26.

As alternate embodiment, a captured spring loaded pull pin can be used to accomplish the same function as the thumb screw 58, for example. Accordingly, the use of thumb screw 58 is not limiting.

In an embodiment, one or more fasteners can be optionally inserted through one or more optional attachment holes 37 on either or both side members 42 and/or 44 and into elongated structure 200. Specifically, one or more attachment holes 37 for semi-permanent attachment of the first clamp body 12 with the elongated structure 200 can be provided on one or both sides of first clamp body 12 (an example of two attachment holes 37 per side member 42, 44 is shown FIG. 1). In one embodiment, one or more attachment holes are provided in either or both side members 42 and/or 44. A fastener (e.g., screw, through bolt) can be inserted through the attachment hole 37 in side member 42 and/or 44 and into elongated structure 200. The fasteners can be screwed in directly to the elongated structure 200, or into holes that are drilled into the elongated structure 200 near the attachment holes 37. For example, once the movable member 28 is installed and tightened against the elongated structure 200, holes can be drilled into or through the elongated structure 200 using the attachment holes 37 as an alignment point. Attachment of the side members 42 and/or 44 using fasteners through attachment holes 37 provides a semi-permanent mounting of the clamp body 12 so that they remain at least temporarily fixed to the elongated structure 200 at a specified length. Temporary securement of the clamp bodies can also allow for high clamping forces.

However, as previously noted, use of a thumb screw 58 and/or fasteners through attachment holes 37 is optional, and need not be provided as the engagement between protruding body 51 and the upper edge of opening 54 alone is sufficient to from a connection when the body 12 is secured to the elongated structure 200. However, the thumb screw 58 may help facilitate the connection even when the clamp assembly is removed from the elongated structure 200 and stored.

In one embodiment, the first clamp body 12 surrounds the elongated structure 200 on which it is mounted. Specifically, side member 42 is configured to extend alongside and adjacent to a first side surface of the elongated structure 200 and side member 44 is configured to extend alongside and adjacent to a second, opposite side surface of the elongated structure 200, the base 46 extends below the elongated structure 200 and connects the side members 42, 44, while the mount structure 26 closes off the upper ends of the side members 42 and 44 above the elongated structure 200. In an embodiment, internal surfaces of each side member 42 and 44, i.e., the surfaces adjacent to elongated structure, are configured to contact a respective side of elongated structure 200. In another embodiment, the internal surfaces of the side members 42 and 44 remain slightly spaced from the sides of elongated structure 200 when the first clamp body 12 is mounted thereon.

A spacing between side members 42 and 44 is configured to accommodate a width of a 2×4 wood structure (e.g., a spacing of approximately 1½ inches to approximately two inches). The spacing of side members 42 and 44 may be designed such that fastening of the side members 42 and 44 of first clamp body 12 move each of their internal surfaces further adjacent to or into contact with a respective side of the wood structure.

In a similar manner, a spacing between upper portion 13 and lower portion 15 of first clamp body 12 is configured to accommodate a height of a 2×4 wood structure (e.g., a spacing of approximately four inches to approximately six inches). For example, in one embodiment, a distance between an underside surface of clamp mount structure 26 and a top surface of base 46 can be designed to accommodate the height of the elongated structure 200. In one embodiment, the spacing between clamp mount structure 26 and base member 46 is greater than the height of the wood structure so that there is sufficient space to allow movement of the movable member 28 into and out of contact with the (bottom) side of the elongated structure 200.

First clamp body 12 and/or adjustable clamp head 14 and/or parts thereof may be formed from cast metal, plastic, plastic composite, for example, or any other number or combinations of materials known in the art.

The second clamp assembly 104 includes a second clamp body 12 and a second workpiece engaging head 62. Second clamp body 12 comprises an upper portion 13 and a lower portion 15 and is configured to engage an elongated structure on which second clamp assembly 104 is to be mounted.

In one embodiment, two opposing adjustable clamp assemblies 102 may be mounted on elongated structure 200 as a pair for clamping a workpiece therebetween. This would allow for adjustable clamping from both opposite ends of the workpiece. In another embodiment, as illustrated, one of the clamp assemblies of the pair 100 is a fixed clamp assembly 104. Specifically, as shown, the fixed clamp assembly comprises a fixed workpiece engaging head 62 for engagement with a workpiece. Second workpiece engaging head 62 is connected with a second clamp body 12, which can, in one embodiment, be identical with the aforementioned clamp body 12 and thus is designated with the same reference numerals. It should be appreciated, however, that different structures can be used for the clamp bodies.

In an embodiment, fixed or anchored clamp head 62 comprises or includes a workpiece engaging head for engaging a workpiece. In one embodiment, it includes an optional second workpiece engaging pad 64. Pad 64 provides a surface for engaging a workpiece. In one embodiment, pad 64 is removable and replaceable. A surface of the pad can be formed from a resilient material that provides friction for griping a workpiece. In another embodiment, pad 64 is simply an integrally formed portion of anchored clamp head 62 and can be formed from a metal material.

As shown in FIG. 3, upper portion 13 of second clamp assembly 104 (as in the first clamp assembly 102) may include teeth 56 to securely mount the body 12 to and substantially prevent movement of second clamp body 12 along the elongated structure (e.g., 2×4 wood structure) once the second clamp body 12 is mounted thereon.

Figure 7:
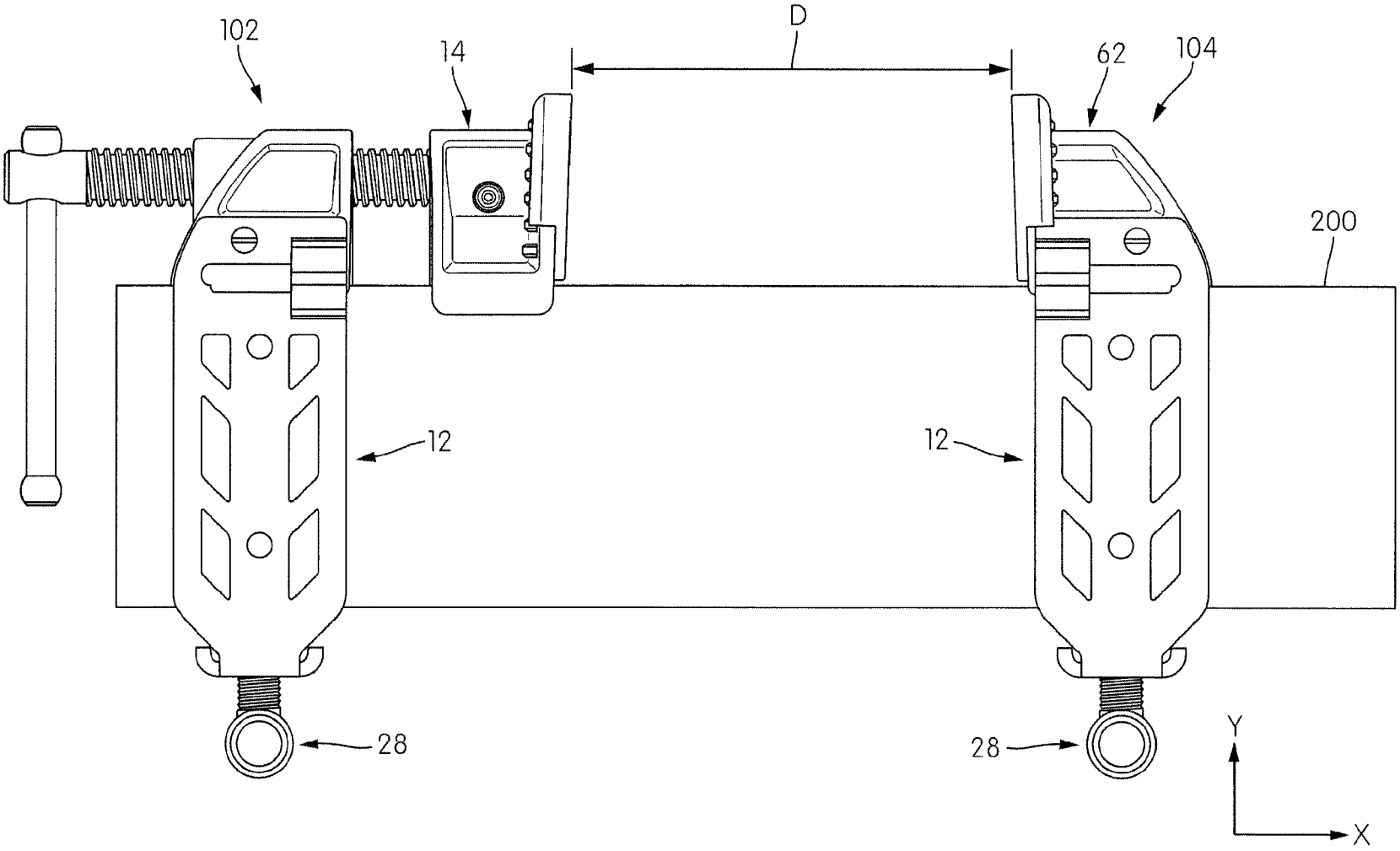
FIGS. 7 and 8 illustrate side and perspective views, respectively, of the clamp assembly pair of FIG. 1 mounted on an elongated structure.
Figure 8:
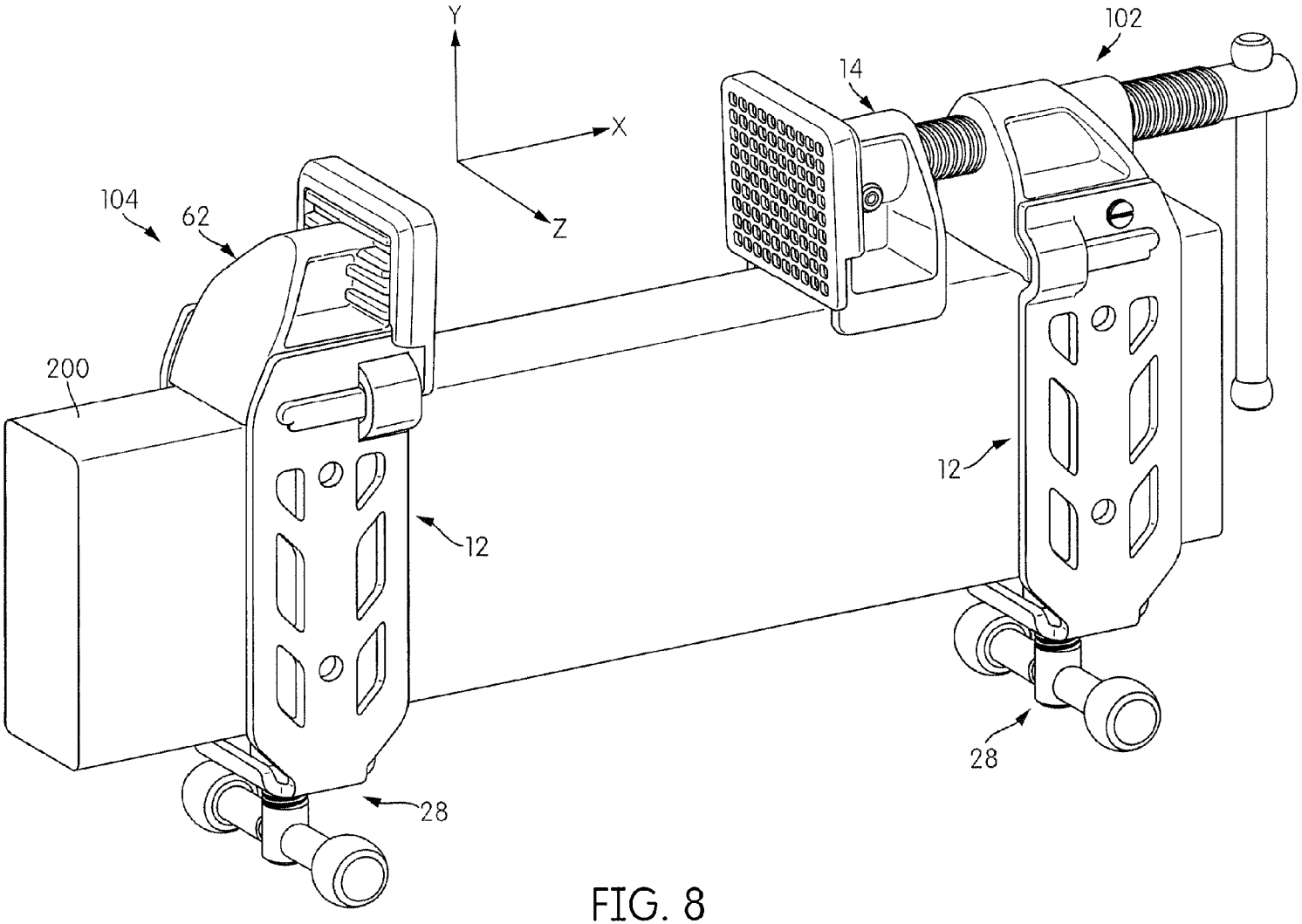

As with the first clamp assembly 102, the second clamp body 12 or the second clamp assembly 104 also has a movable member 28 associated with its lower portion 15. The movable member 28 is arranged to be moved into forced engagement with an exterior surface (e.g., such as the bottom side surface) of the elongated structure to fix second clamp body 12 on the elongated structure. For example, second movable member 28 may be configured to move in a vertical direction relative to a wood 2×4 such that it can be engaged or disengaged with a bottom side surface of the 2×4. Second clamp body 12 of the second clamp assembly 104 is mounted on elongated structure 200 in spaced relation relative to the first clamp body 12 of the first clamp assembly 102 to accommodate a workpiece for clamping. For example, second clamp body 12 of the second clamp assembly 104 can be positioned a distance D (e.g., see FIG. 7) from the first clamp body 12 of the first clamp assembly 102 to receive a workpiece therebetween. Alternatively, the second clamp body 12 is initially mounted on the elongated structure 200 and the first clamp body 12 is positioned a distance D from the second clamp body 12. Distance D defines an area between the workpiece clamping surfaces that is at least substantially similar in dimension as a workpiece to be clamped, if not larger.

The second movable member 28 of the second clamp assembly 104 is also arranged to be movable away from forced engagement to allow second clamp body 12 to be loosened from the elongated structure 200. Second movable member 28 can have a contact portion 34 on one end thereof (see FIG. 3) for contact with the 2×4. When second movable member 28 is moved into forced engagement with 2×4, contact portion 34 is engaged with (bottom) exterior surface of the wood structure. In accordance with an embodiment, rotational movement of second movable member 28 of second clamp assembly 104 moves contact portion 34 in a vertical direction towards or away from a 2×4 as described with respect to the first clamp assembly 102. In addition, one skilled in the art will appreciate that the connection of the second body 12 of the second clamp assembly 104 with the fixed or anchored clamp head 62 will occur in essentially the same manner as the connection between the clamp mount structure 26 with the first body 12 of the first clamp assembly 102. Specifically, the fixed clamp head 62 is provided with essentially the same or similar attachment portions 51 (with projections 51, channels 53, and flanges 57) as is provided on the clamp mount structure 26. The difference in the embodiment of the second clamp assembly 104 is that its clamp head 62 is fixedly attached to the body 12 (rather than movably attached). In addition, a lower portion of the fixed or anchored clamp head 62 cooperates with the second body 12 of the second clamp assembly 104 to close off the upper end of side portions 42 and 44 to surround the elongated structure 200. The anchored clamp head 62 may alternatively be viewed as having the lower portion thereof that is connected with the upper portions of side portions 42 and 44 as being part of (and the completion of) the body 12, while also having a front portion thereof (optionally with or without a removable pad) serving as the workpiece engaging head for engaging the workpiece.

In one embodiment, one or both clamp assemblies can be attached to and released from an elongated structure (e.g., 2×4 wood structure) 200 in a direction that is transverse to a longitudinal direction of the elongated structure, without requiring access to an end of the 2×4. Attachment and removal of the clamp body 12 with respect to the 2×4 wood structure 200 is further shown and described relative to FIGS. 4-6. In these Figures, for explanatory purposes only, steps for attaching second clamp assembly 104 to part of a 2×4 wood structure 200 are shown. However, as previously described, it should be understood that first clamp assembly 102 may be assembled and attached to the 2×4 wood structure 200 in a substantially similar manner (e.g., and in a spaced relation to the second clamp body and/or based on a width of the workpiece to be clamped). The order or manner of attachment of any clamp assembly to the 2×4 is not meant to be limiting.

To attach a second clamp assembly 104 to a longitudinally positioned 2×4 wood structure 200, anchored clamp head 62 can be mounted or placed on a top side surface of the 2×4 as shown in FIG. 4. Any teeth 56 on the underside surface of the head 62 can assist in gripping the wood for mounting and anchoring thereof. Brackets or side members 42 and 44 of the second clamp body 12 are positioned around sides of 2×4 wood structure 200 and moved in a (vertical) direction towards the anchored clamp head 62, as indicated by arrow C in FIG. 4, to substantially surround the sides of the wood structure 200. Then, as shown in FIG. 5, the movable member 28 and brackets 42 and 44 of second clamp body 12 are moved towards the anchored clamp head 62, as indicated by arrow E. Bracket attachment portions 52 are aligned with the support structure 45 of each bracket 42 and 44. The brackets or side members 42 and 44 are slid horizontally such that protruding bodies 51 of the bracket attachment portions 52 on each side of anchored clamp head 62 slide at least partially past their respective support structures 45 and into connection openings 54. At least upper edges of connection openings 54 of the side members 42 and 44 are guided by channels 53 of the protruding bodies 51 towards closed ends 55. Once sliding has commenced and the bracket attachment portions 52 are received in openings 54, receiving opening 59 of bracket 44 and the opening 61 of anchored clamp head 62 will be substantially in-line with each other. A thumb screw 58 is optionally inserted through receiving opening 59 and screwed into the opening 61 to connect second clamp body 12 to anchored clamp head 62. As the thumb screw 58 is tightened, it threads into receiving opening 59 of bracket 44. The threads of receiving opening 59 keep the thumb screw 58 engaged and prevent clamp head 62 from moving or sliding off of the clamp body 12. After thumb screw 58 is tightened, the second movable member 28 is moved into contact with the (bottom) exterior surface of the 2×4, as shown in FIG. 6. Specifically, handle 30 is rotated about its axis (e.g., in a clockwise direction), as shown by arrow F, which in turn moves the screw threads 32 of movable member 28 through through hole portion 38. As the second movable member 28 is rotated using screw threads 32, it is moved in a vertical direction, as indicated by arrow G, and contact portion 34 and teeth 35 are moved into engagement with (bottom) exterior surface of wood structure 200, thereby securing the second clamp assembly 104 to the 2×4.

In another embodiment, as thumb screw 58 is tightened, brackets or side members 42 and 44 are also tightened around the 2×4.

Conversely, the method of releasing and removing the second clamp assembly 104 from a 2×4 wood structure 200 includes steps that are substantially opposite to those described and shown above in FIGS. 4-6. To release the second clamp assembly 104, the method of removal starts by loosening second movable member 28 of second clamp body 12 away from said forced engagement with the bottom side surface of the wood structure 200 by turning handle 30 rotationally (e.g., in a counter-clockwise direction). Then, the optional thumb screw 58 is rotated such that it is retracted from its opening 61 in anchored clamp head 62 and removed from the opening 61 and unthreaded from receiving opening 59 of side member 42. The side members 42 and 44 are then unattached from anchored clamp head 62 by sliding second clamp body 12 away from anchored clamp head 62 (in a direction opposite to arrow E in FIG. 5). Specifically, protruding bodies 51 of bracket attachment portions 52 are withdrawn from releasable connection openings 54 by sliding edges of the openings 54 out of the channels 53 via open ends 49. The side members 42 and 44 of second clamp body 12 are moved or slid away from anchored clamp head 62. For example, with reference to FIG. 4, the second clamp body 12 may be moved in a transverse direction (e.g., vertically downward; a direction opposite to that of arrow C) relative to the longitudinal direction of the 2×4 wood structure 200. Anchored clamp head 62 can be lifted (e.g., in a vertical or Y-direction) to release any engagement of the teeth 56 with the top side of the wood structure 200, and to remove the head 62 therefrom. Accordingly, second clamp body 12 is released from the wood structure 200 without requiring the clamp body 12 to be longitudinally slid past an end thereof.

Again, it should be understood that first clamp body 12 and clamp mount structure 26 of first clamp assembly 102 may be assembled and released from the 2×4 wood structure in a substantially similar manner as described above with reference to the removal of the second clamp assembly 104. For example, clamp mount structure 26 can be mounted with attached adjustable clamp head 14 on a top side surface of the 2×4. The clamp mount structure 26 can be placed on the 2×4 such that adjustable clamp head 14 is spaced at least distance D from a fixed clamp head, e.g., the anchored clamp head 62 of the second clamp body 12, for example. Overhanging lip 50 of adjustable clamp head 14 straddles the sides of the 2×4 and helps prevent rotation of the head 14 when the screw 18 is rotated. Any teeth 56 on the underside surface of the mount 26 can assist in gripping the wood for mounting and anchoring thereof. Brackets or side members 42 and 44 of first clamp body 12 are aligned around sides of 2×4 wood structure 200 and moved in a (vertical) direction towards clamp mount structure 26, to substantially surround the sides of the wood structure. Then, the first clamp body 12 is moved towards clamp mount structure 26. Bracket attachment portions 52 are aligned with support structures 45 of each side member 42 and 44. The side members 42 and 44 are slid horizontally such that protruding bodies 51 of the bracket attachment portions 52 on each side of clamp mount structure 26 slide at least partially past their respective alignment portions 45 and into connection openings 54. At least upper edges of connection openings 54 of the brackets 42 and 44 are guided by channels 53 of protruding bodies 51 towards closed ends 55. Once sliding has commenced and edges of the bracket attachment portions 52 are received in openings 54, receiving opening 59 of bracket 44 and opening 61 of clamp mount structure 26 will be substantially in-line with each other. A thumb screw 58 is optionally screwed through the receiving opening 59 and inserted into the opening 61 to connect first clamp body 12 to workpiece engaging head 14 via clamp mount structure 26. As the thumb screw 58 is tightened, it threads into the bracket 44 at receiving opening 59 and is inserted into non-threaded hole 61. The threads of receiving opening 59 on the bracket 44 keep the thumb screw 58 engaged, and prevents the clamp head 62 from sliding off the clamp body 12. After thumb screw 58 is tightened, the first movable member 28 is moved into contact with the (bottom) exterior surface of the 2×4. Specifically, handle 30 is rotated about its axis (e.g., in a clockwise direction) which in turn moves the screw threads 32 of movable member 28 through through hole portion 38. As the second movable member 28 is rotated using screw threads 32, it is moved in a vertical direction, and contact portion 34 and teeth 35 are moved into engagement with (bottom) exterior surface of wood structure 200 thereby securing the first clamp assembly 102 to the 2×4.

Conversely, the method of releasing and removing the first clamp assembly 102 from a 2×4 wood structure 200 includes steps that are substantially opposite to those described above. To release the first clamp assembly 12, the method of removal starts by moving second movable member 28 of first clamp body 12 away from said forced engagement with the bottom side surface of the wood structure 200 by turning handle 30 rotationally (e.g., in a counter-clockwise direction). Then, the optional thumb screw 58 is loosened such that it is retracted from its opening 61 in clamp mount structure 26 and removed from the opening 61 and receiving opening 59 of bracket 44. The brackets 42 and 44 are then unattached from clamp mount structure 26 by sliding first clamp body 12 away from clamp mount structure 26. Specifically, protruding bodies 51 of bracket attachment portions 52 are withdrawn from releasable connection openings 54 by sliding edges of the openings 54 out of the channels 53 via open ends 49. The side members 42 and 44 of first clamp body 12 are moved or slid away from clamp mount structure 26. For example, the first clamp body 12 may be moved in a transverse direction (e.g., vertically downward) relative to the longitudinal direction of the 2×4 wood structure 200. Clamp mount structure 26 can be lifted (e.g., in a vertical or Y-direction) to release any engagement of the teeth 56 with the top side of the wood structure 200, and to remove the clamp mount structure 26 and adjustable clamp head 14 from the structure. Accordingly, first clamp body 12 is released from the wood structure 200 without requiring the clamp body 12 to be longitudinally slid past an end thereof.

The order of removal or placement of any clamp assembly with respect to the 2×4 is not limiting.

It should also be understood that, in accordance with another embodiment, only one of the clamp assemblies in the clamp assembly pair 100 may comprise the removable connection and illustrated configuration as shown and described herein. That is, although both first and second clamp assemblies of the clamp assembly pair 100 are shown in the Figures to have a corresponding releasable connection, one of the clamp assemblies may include different attachment and mounting parts, and may be configured for attachment to a 2×4 or structural member in a different manner.

Figure 10:
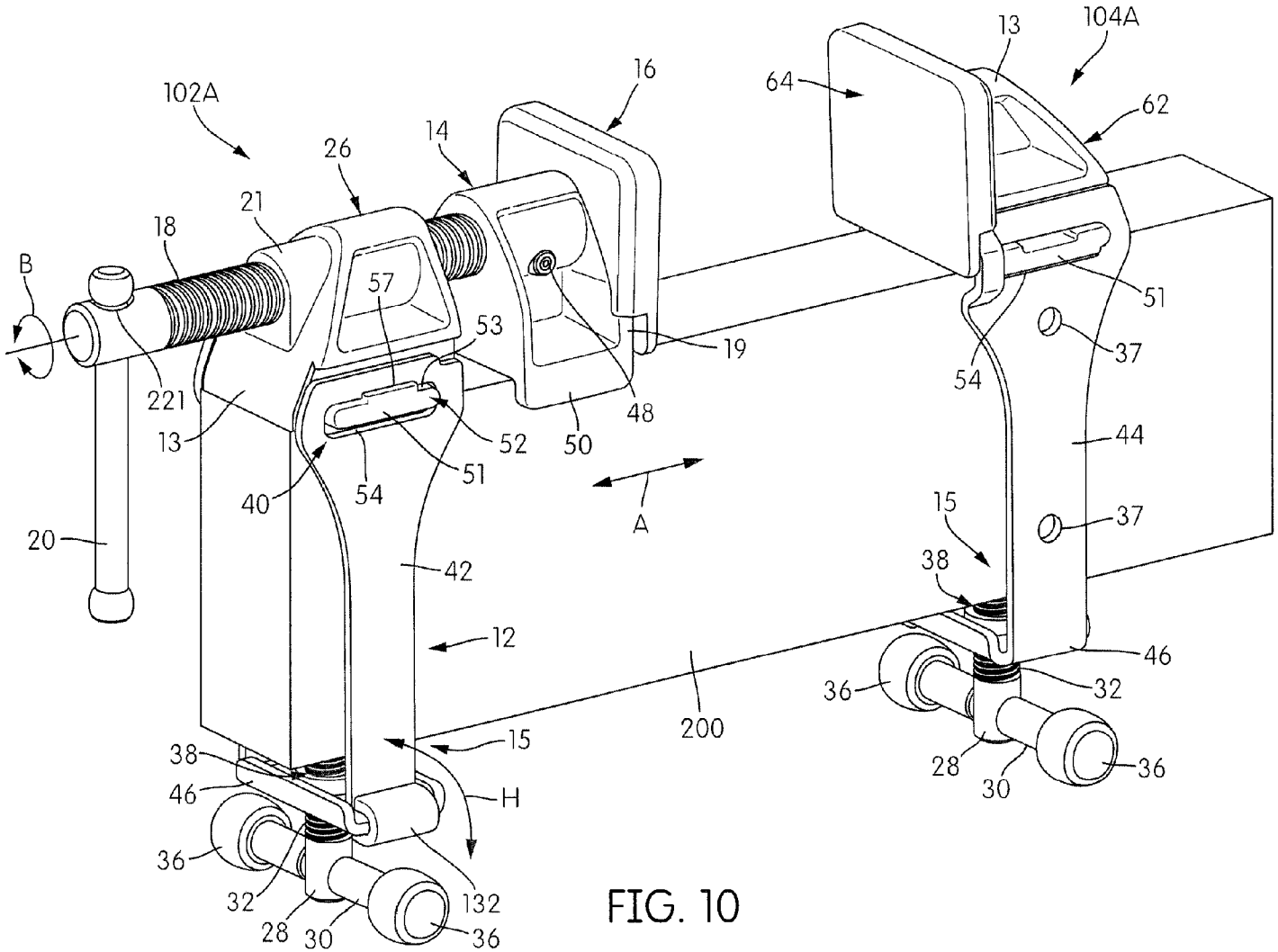
FIG. 10 illustrates a perspective view of a clamp assembly pair in accordance with another embodiment of this disclosure.
Figure 11:
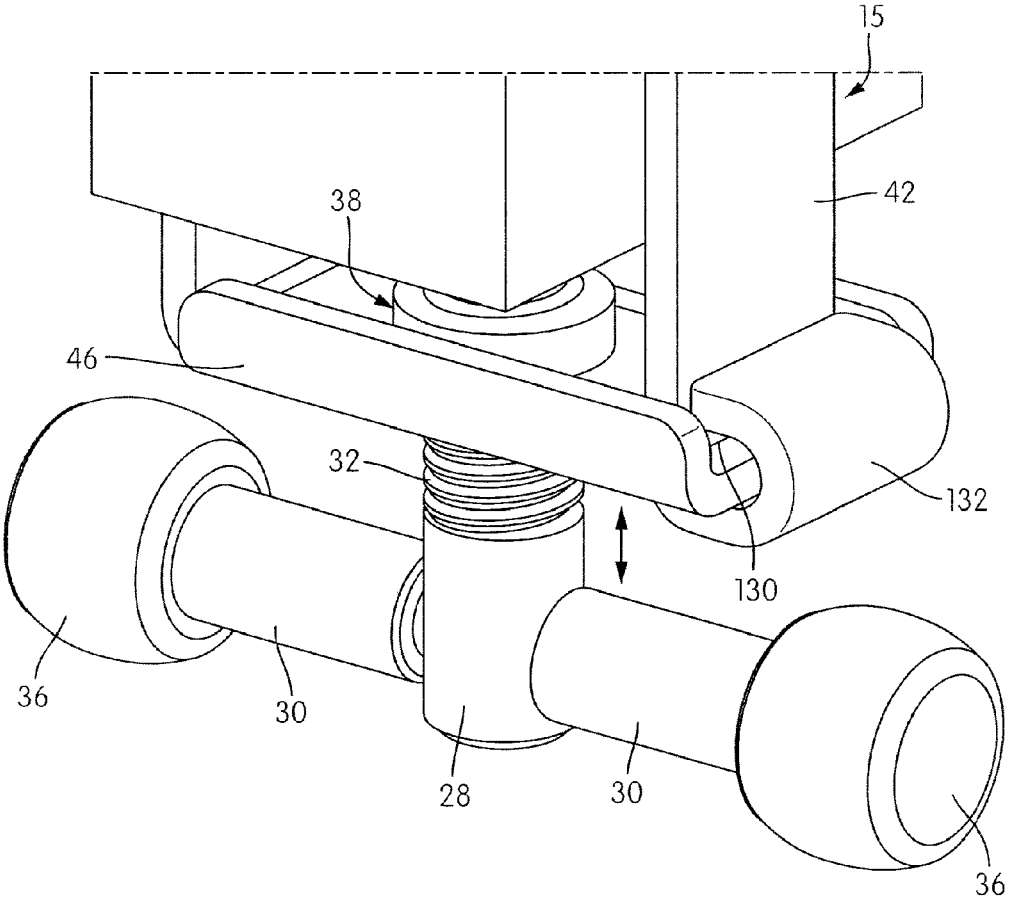
FIG. 11 illustrates a detailed, perspective view of a movable member of a clamp assembly of FIG. 10 in accordance with an embodiment of this disclosure.

Moreover, in accordance with yet another embodiment, a single releasable connection is provided on a clamp assembly, rather than one provided on each side. In this embodiment, as shown in FIGS. 10 and 11, a side member or bracket is configured for pivotal movement away from the elongated structure when released. FIG. 10 illustrates a perspective view of the alternate clamp assemblies 102A and 104A each with a clamp body in accordance with another embodiment of this disclosure. For purposes of clarity and brevity, like elements and components in FIG. 10 are labeled with same designations and numbering as discussed with reference to FIGS. 1-6. Thus, although not discussed entirely in detail herein, one of ordinary skill in the art should understand that various features associated with the clamp body and assembly of FIG. 10 are similar to those features previously discussed.

Specifically, like the clamp bodies described above, clamp body 12 shown in FIG. 10 has an upper portion 13 and a lower portion 15 and is configured to engage an elongated structure 200 on which the clamp assembly is to be mounted. A workpiece engaging head 14 is connected with the clamp body 12. The clamp body 12 includes a movable member 28 arranged to be moved into forced engagement with an exterior surface (e.g., bottom surface) of the elongated structure 200 to fix the clamp body on the elongated structure 200 and that is also movable away from said forced engagement to allow the clamp body to be loosened from the elongated structure 200.

In the illustration shown in FIG. 10, the clamp body 12 is visibly shown on one side and associated with a clamp mount structure associated with an adjustable clamp head. However, the clamp body can also be connected with an anchored clamp head. In one embodiment, the clamp body 12 is configured to be mounted on elongated structure 200 in spaced relation relative to another clamp body.

The clamp assembly 102A has at least one releasable connection that is constructed and arranged to be released so that the clamp assembly can be installed on and released from the elongated structure 200 without requiring the relative clamp body to be longitudinally slid over or past an end of the elongated structure. For example, in one embodiment, and as will be described in greater detail later, the clamp assembly 102A has a releasable connection 40 that is constructed and arranged for attachment and release of the clamp body 12 with a 2×4.

In an embodiment, the releasable connection is provided between upper portion 13 and lower portion 15 of the clamp body 12. For example, in one embodiment, the releasable connection can be provided anywhere between its head 26 or 62 and the movable member 28 (and its associated lower portion 15).

In one embodiment, the releasable connection 40 is provided towards the upper portion 13 of the clamp body 12 and can be used to connect the upper portion 13 and lower portion 15. For example, the clamp body 12 may employ portions of its side members 42 and 44 to be connected with the upper portion 13 or head 26 or 62. As shown, in this embodiment, the clamp body 12 will surround an elongated structure 200 when the connection 40 operates toconnect the upper and lower portions 13, 15. In the illustrated exemplary embodiment of FIG. 10, the brackets or side members 42 and 44 of body 12 may also be considered or viewed as a first connector 42 and second connector 44 to connect the movable member 28 and base 46 to the workpiece engaging head 14 or 62. Each bracket or side member 42 and 44 can extend substantially vertically (or substantially perpendicularly) from base 46.

In various embodiments, one or both of the side members 42, 44 are pivotable with respect to the base 46 on lower portion 15 of first clamp body 12. FIGS. 10 and 11 show an example of only one of the side members 42 and 44 being pivotally connected to the base 46. As shown in greater detail in FIG. 11, base 46 includes one or more openings 130 at an end thereof to enable at least one portion (e.g., side member 42 and/or 44) of clamp body 12 to move in pivotal relation to the base 46. In FIG. 11, only one side of the clamp assembly 102A and clamp body 12 are shown; however, the herein described features can be applied to either or both side members 42, 44 or brackets on either side of the clamp body 12.

At least one portion of each of the side members 42 and 44 has a connector portion that is engagable and disengagable. In one embodiment, head 26 or 62 includes bracket attachment portions 52 on both of its sides for releasable connection with both side members 42 and 44. In another embodiment, the head is integrally formed and permanently connected to one of the side members 42 or 44. Each bracket attachment portion 52 includes a protruding body 51 with a channel 53 and at least one flange 57 on an outer edge of channel 53. In one embodiment, a flange 57 is provided on opposing sides of each channel 53. Channel 53 is provided to receive a portion of a bracket or a side member therein.

In one embodiment, an opening 130 is formed in base 46 and is configured to receive a lower portion 132 of a side member 42 therein (or two openings 130 can be provided on opposite sides of base 46 to receive lower portions of both side members 42 and 44) to form a rotatable joint for movement of the side member 42 towards and away from elongate structure 200. The bottom portion 132 on the side member(s) is formed into a curved structure configured for insertion into opening 130 and formed around the edge of the base 46. A curved bottom portion 132 can freely pivot within the opening 130 and rotate about an edge of the base 46, as indicated by arrow H in FIG. 10.

At least of the side members 42 and 44 has a connector portion that is engagable and disengagable. Side members 42 and 44 can be configured for connection and disconnection with workpiece engaging head 14, for example. In one embodiment, the head includes bracket attachment portions 52 on either of its sides for releasable connection with side members 42 and 44. Each bracket attachment portion 52 includes a protruding body 51 with a channel 53 and at least one flange 57 on an outer edge of channel 53. In one embodiment, a flange 57 is provided on opposing sides of each channel 53. Channel 53 is provided to receive a portion of a bracket or a side member therein. Each flange 57 is configured to assist in maintaining receipt of a portion of the side member therein.

Specifically, one or each side member 42 and 44 can have a releasable connection opening 54 on an upper portion thereof. The releasable connection opening 54 on the side member is configured for receipt of the bracket attachment portion 52 on the anchored head 62 of the clamp assembly 102A (or the bracket attachment portion 52 on the clamp mount structure 26, depending on whether the clamp assembly 102A has a clamp mount structure similar to the first clamp assembly 102 or an anchored head similar to the second clamp assembly 104). More specifically, the upper edge of each releasable connection opening 54 is configured for receipt within the channel 53 of a respective protruding body 51.

In one embodiment, the opening(s) 54 are closed ended (not slots) and the side member (42 and/or 44) is simply pivoted so that the opening 54 rides over and received the protruding body 51. The movable member 28 is then tightened as previously described.

Thus FIGS. 10 and 11 show an optional embodiment that can include pivotal attachment of a clamp body 12 to elongate structure 200. To attach a clamp assembly 102A to a longitudinally positioned 2×4 wood structure 200, for example, workpiece engaging head 14 is mounted on a (top) side surface of the 2×4 as shown in FIG. 10. The side members 42 and 44 of clamp the body 12 are aligned around sides of 2×4 wood structure 200 by rotating each about their rotatable joints in a substantially upward direction towards the head 14, as indicated by arrow H. The curved bottom portion 132 of each side members 42, 44 is rotated within its respective opening 130 around an edge of the base 46 such that the connection openings 54 are aligned with the protruding bodies 51 of the bracket attachment portions 52. The protruding bodies 51 are guided for receipt within connection openings 54, and the edges of the bodies 51 are received within the channels 53 and held by flanges 57. Then the movable member 28 is moved into contact with the (bottom) exterior surface of the 2×4. Specifically, handle 30 is rotated about its axis (e.g., in a clockwise direction) which in turn moves the screw threads 32 of movable member 28 through through hole portion 38. As the movable member 28 is rotated using screw threads 32, it is moved in a vertical direction into engagement with (bottom) exterior surface of wood structure 200, thereby securing the clamp assembly 102A to the 2×4.

Accordingly, it should also be understood be one of ordinary skill in the art, then, that, optionally, a method of releasing the releasable connection may further include pivoting the releasable connection away from the elongated structure. For example, to release the clamp assembly 102A, the method of removal starts by moving the movable member 28 of the clamp body 12 away from said forced engagement with the bottom side surface of the wood structure 200 by turning handle 30 rotationally (e.g., in a counter-clockwise direction). The side members 42 and 44 of the clamp body 12 are then unattached from the head by lifting each side member such that at least upper edges of the openings 54 are removed away from channels 53 to clear flanges 57. Each bracket is pivoted about its rotatable joint by moving the brackets substantially downwardly so that protruding bodies 51 are withdrawn from openings 54 and the curved bottom portions 132 rotate within their respective openings 130 around an edge of the base 46. Then, the clamp body 12 is released from engagement with the head 14. The side members 42, 44 can be lifted and rotated to release assembly of the clamp body 12 with the head 14 either separately or concurrently. The workpiece engaging head 14 can be lifted (e.g., in a vertical or Y-direction) to release any engagement with the top side of the wood structure 200. Accordingly, the clamp body 12 of FIGS. 10 and 11 is released from the wood structure 200 without requiring the clamp body 12 to be longitudinally slid past an end thereof.

In still yet another embodiment, the releasable connection 40 of the clamp body 12 may be provided on its lower portion 15, and still embody the features of the disclosed clamp assembly herein (e.g., including a movable member arranged to be moved into forced engagement with an exterior surface of the elongated structure to fix the clamp body on the elongated structure, the movable member being movable away from said forced engagement to allow the clamp body to be loosened from the elongated structure and a releasable connection constructed and arranged to be released so that the clamp assembly can be installed on and released from the elongated structure without requiring the clamp body to be longitudinally slid past an end of the elongated structure). For example, one of ordinary skill in the art understands that a releasable connection 40 of the clamp body 12 can connect the clamp body 12 to its movable member 28 or base 46 for mounting on the elongated structure 200. For example, the clamp body 12 may include connectors, e.g., in the form of releasable brackets, that are configured to be released from engagement with movable members 28 or base 46.

In one embodiment, an end of each of the side members 42, 44 is connected to a relative workpiece engaging head 14 on upper portions 13 of the clamp body 12. In another embodiment, an end of each of the side members 42, 44 is integrally formed with the workpiece engaging head 14 or the clamp mount structure 26 on upper portions 13 of the clamp body 12.

Figure 12:
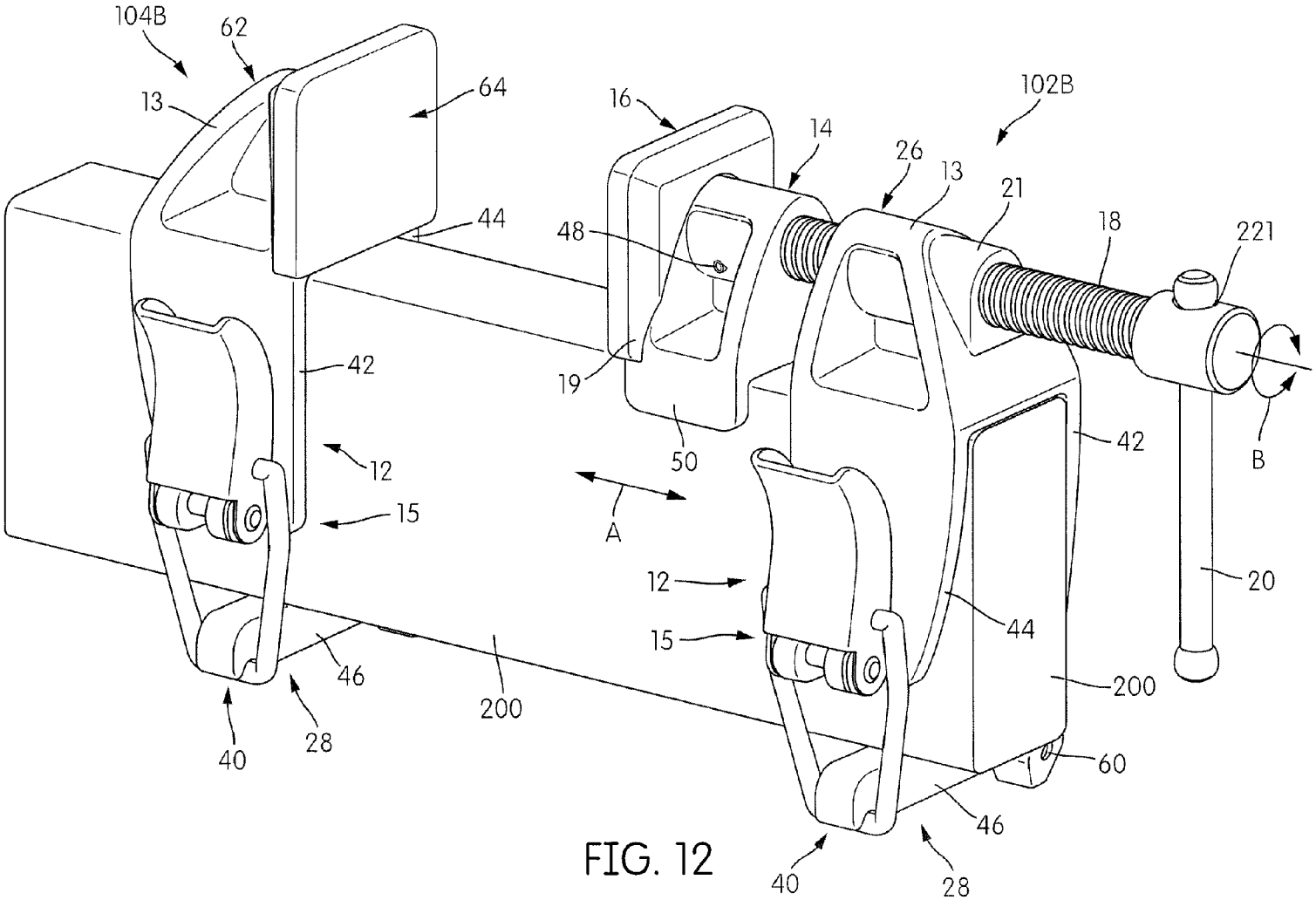
FIG. 12 illustrates a perspective view of a clamp assembly pair in accordance with yet another embodiment of this disclosure.
Figure 14:
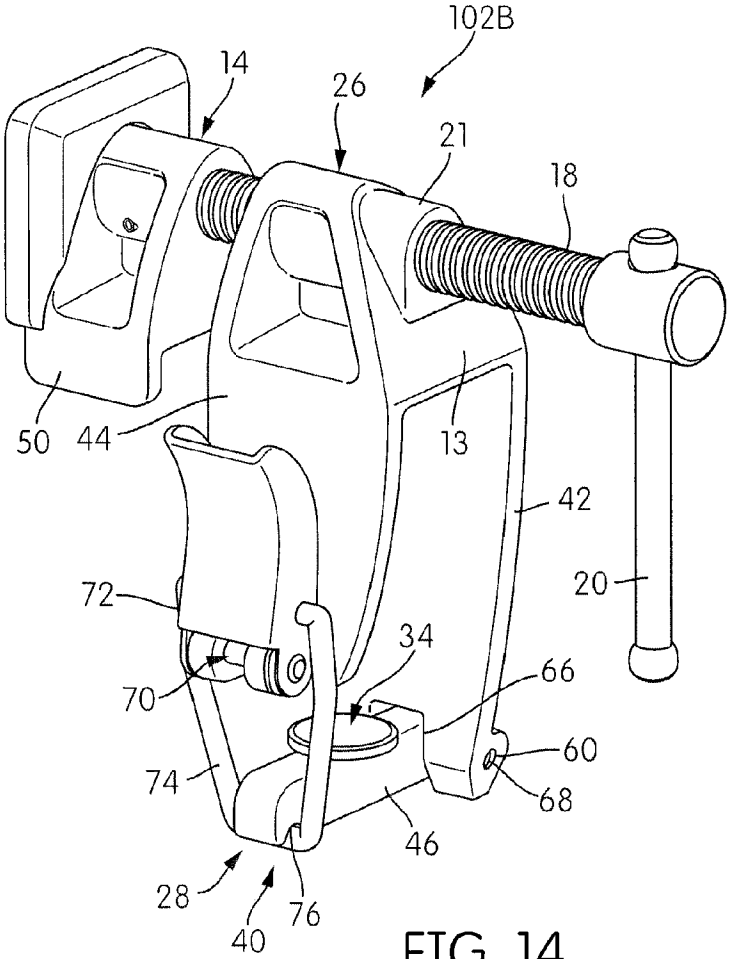
FIGS. 13 and 14 show a single releasable connection of a clamp assembly of FIG. 12 in unlocked and locked positions, respectively.
Figure 13:
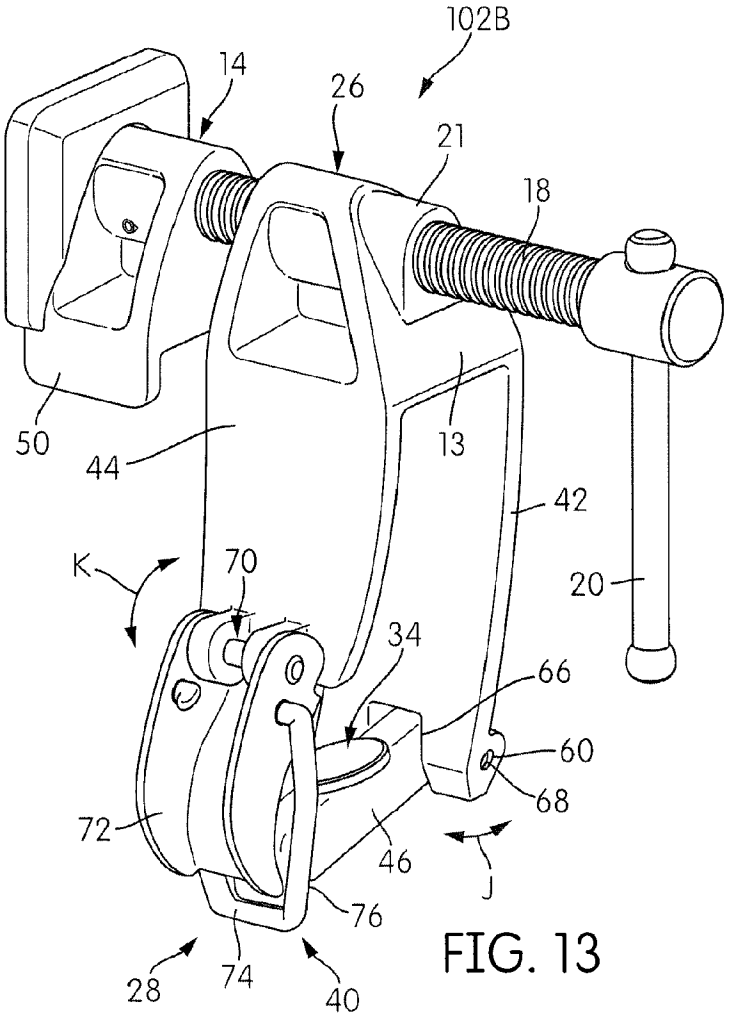

FIGS. 12-14 show a further embodiment, comprising a first clamp assembly 102B and a second clamp assembly 104B wherein side members 42 and 44 are integrally formed (e.g., integrally forged or molded) with the clamp mount structure 26 and/or anchored clamp head 62. In this embodiment, the first clamp assembly 102B and the second clamp assembly 104B each have a releasable connection 40 provided towards the lower portion 15 of the clamp body 12 that is constructed and arranged for attachment and release of the clamp body 12 with a 2×4. In this embodiment, the releasable connection 40 comprises a latch configured to capture a portion of the base 46 to lock the clamp body 12 around the elongated structure. For purposes of clarity and brevity, like elements and components in FIGS. 12-14 are labeled with same designations and numbering as discussed with reference to FIGS. 1-6. Thus, although not discussed entirely in detail herein, one of ordinary skill in the art should understand that various features associated with the clamp body and assembly of FIGS. 12-14 are similar to those features previously discussed.

Like the clamp bodies described above, each clamp body 12 shown in FIG. 12 has an upper portion 13 and a lower portion 15 and is configured to engage an elongated structure 200 on which the clamp assembly is to be mounted. A workpiece engaging head 14 is connected with the clamp body 12. The clamp body 12 includes a movable member 28 arranged to be moved into forced engagement with an exterior surface (e.g., bottom surface) of the elongated structure 200 to fix the clamp body on the elongated structure 200 and that is also movable away from said forced engagement to allow the clamp body to be loosened from the elongated structure 200.

The clamp assemblies 102B and 104B have at least one releasable connection that is constructed and arranged to be released so that the clamp assembly can be assembled on and/or released from the elongated structure 200 without requiring the relative clamp body to be longitudinally slid over or past an end of the elongated structure. For example, in one embodiment, the clamp assemblies 102B and 104B have a releasable connection 40 that is constructed and arranged for attachment and release of the clamp body 12 with a 2×4.

The clamp body 12 may employ portions of its side members 42 and 44 to be connected with the lower portion 15 or movable member 28. As shown, in this embodiment, the clamp body 12 will surround an elongated structure 200 when the connection 40 operates to connect the side members 42 and 44. Each bracket or side member 42 and 44 can extend substantially vertically (or substantially perpendicularly) from clamp mount structure 26 or anchored clamp head 62.

In the illustrated exemplary embodiment of FIGS. 13 and 14, showing exemplary details related to first clamp assembly 102B, the base 46 of movable member 28 may be considered or viewed as a releasable connector that is used to connect the movable member 28 and side members 42 and 44 of the clamp body 12. The base 46 is pivotable with respect to one of the side members 42 or 44 via pivot hinge connection 60 on lower portion 15 of the clamp body 12. FIGS. 13 and 14 show an example of base 46 in the form of a releasable latch bar configured to releasably connect with a lock ring 74 of latch 40. Specifically one end of the latch bar of base 46 is pivotally connected to side member 42, and a lever 72 of latch (removable connection) 40 is hingedly connected to side member 44. However, as evidenced by the features shown in FIG. 12 with respect to second clamp assembly 104B, base 46 may be configured to be Pivotally connected to side member 44, and lever 72 hingedly connected to side member 42. Accordingly, it should be understood by one of ordinary skill in the art that the features described with regard to first clamp assembly 102B are not limiting. Further, first clamp assembly 102B may have, in one embodiment, a similar configuration as second clamp assembly 104B, and/or latch 40 associated with side member 44.

Referring back to FIG. 13, in this illustration of first clamp assembly 102B, the connection end of the latch bar of base 46 is aligned within a receiving area 66 on a bottom portion of the side member 42. The receiving area 66 includes integrated leg or foot members configured to substantially surround sides of the connection end of the base 46. The leg members have holes 68 therethrough. Base 46 also includes one or more through hole openings at its connection end that are aligned with the holes 68 of the side member 42 and configured to receive a pivot pin, for example, therethrough to form the pivot hinge connection 60 and thus form a rotatable joint for movement of the base 46 towards and away from elongate structure 200. The latch bar of base 46 of clamp body 12 is configured to move at its connection end in pivotal relation to the side member 42.

Latch 40 includes lever 72, lock ring 74, and base 46 that can be moved between an unlocked position (e.g., see FIG. 13) and a locked position (e.g., see FIG. 14). Lever 72 is hingedly connected at a lower portion of side member 44 via hinge 70. Lock ring 74 is connected to lever 72 which is configured to cooperatively move lock ring 74 between locked and unlocked positions. One of ordinary skill in the art generally understands the formation and operation of such a latch, and therefore the parts are not discussed in great detail herein.

The opposite end of base 46 is a lock end configured to be releasably captured and at least temporarily secured by lock ring 74. More specifically, the opposite end of the latch bar acts as a connector portion that is engagable and disengagable with lock ring 74 of latch 40. In one embodiment, the opposite end includes a receiving area 76 configured for alignment and connection with lock ring 74. The receiving area 76 on the base 46 is configured for receipt of a portion of lock ring 74 therein when it is aligned on top of lock ring 74. Once lock ring 74 is aligned with base 46, the lever 72 can be pivoted upwardly towards upper portion 13. The handle 72 is configured to rotate about its hinge 70 to pull base 46 upwardly about its pivot hinge connection 60 to secure at least contact portion 34 of base 46 against a side (bottom) portion of the elongated structure 200. The movable member 28 is accordingly tightened against the elongated structure via movement of the lever 72 into a locked position, as shown in FIG. 14.

Thus FIGS. 12-14 show an optional embodiment that can include pivotal attachment of a clamp body 12 to elongate structure 200. To attach a clamp assembly 102B to a longitudinally positioned 2×4 wood structure 200, for example, workpiece engaging head 14 is mounted on a (top) side surface of the 2×4. The side members 42 and 44 of clamp the body 12 are aligned around sides of 2×4 wood structure 200. The base 46 can be rotated about its pivot hinge connection 60, as indicated by arrow J in FIG. 13, for alignment of its receiving area 76 on lock ring 74 by rotating it in a substantially upward direction, towards a bottom side of the elongated structure 200. The lock ring 74 is received within receiving area 76 of base 46. Then the base 46 of the movable member 28 is moved into contact with the (bottom) exterior surface of the 2×4. Specifically, handle 72 is rotated about its hinge 70 (e.g., in a clockwise direction) towards upper portion 13 of the clamp body 12, as indicated by arrow K in FIG. 13, which in turn pulls, the lock ring 74 up, which in turn moves the base 46 of movable member 28 pivotally and substantially in a vertical, upward direction with respect to elongated structure 200. As the base 46 of the movable member 28 is rotated and locked, it is moved in a vertical direction into engagement with (bottom) side surface of wood structure 200, via contact portion 34, thereby securing the clamp assembly 102B to the 2×4.

Accordingly, it should also be understood be one of ordinary skill in the art, then, that, optionally, a method of releasing the releasable connection 40 may further include pivoting the releasable connection (e.g., base 46) away from the elongated structure. For example, to release the clamp assembly 102B, the method of removal starts by rotating the lever 72 downwardly towards lock ring 74 (e.g., in a counter-clockwise direction) so that the base 46 is moved away from said forced engagement with the bottom exterior surface of the wood structure 200. The contact portion 34 of base 46 is released from contact and the base 46 moves pivotally downwardly. The base 46 can then be moved out of connection with lock bar 46 by lifting the latch bar at its opposite end away from lock ring 74. The base 46 is pivoted about its pivot hinge connection 60 away from the lever 72. Then, the clamp body 12 is released from engagement with the elongated structure 200. The head 14 and side members 42, 44 can be lifted to release the clamp body 12 (e.g., in a vertical or Y-direction) from engagement with the top side of the wood structure 200. Accordingly, the clamp body 12 of FIGS. 12-14 is released from the wood structure 200 without requiring the clamp body 12 to be longitudinally slid past an end thereof.

Figure 15:
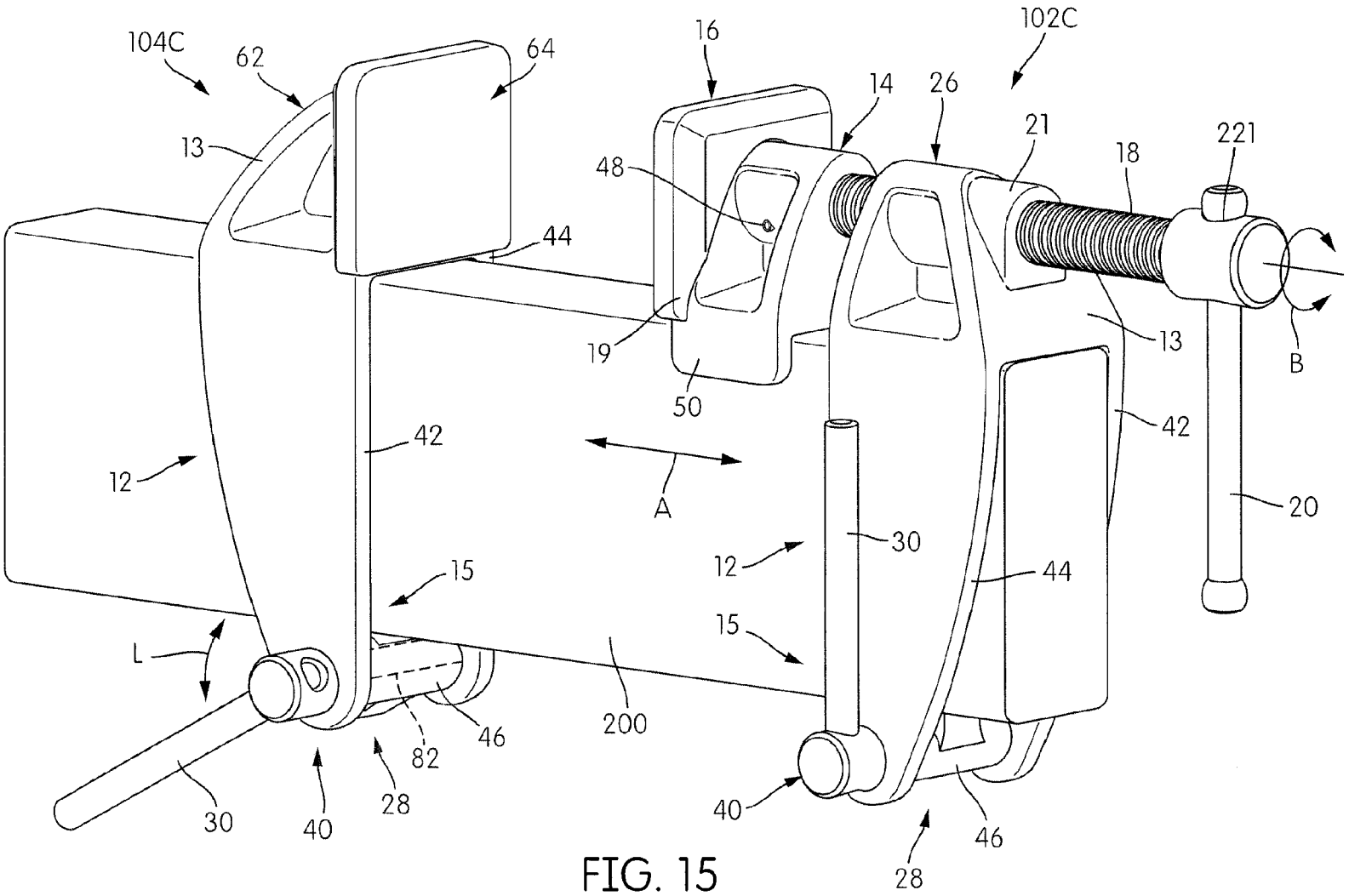
FIG. 15 illustrates a perspective view of a clamp assembly pair in accordance with still yet another embodiment of this disclosure.
Figure 16:
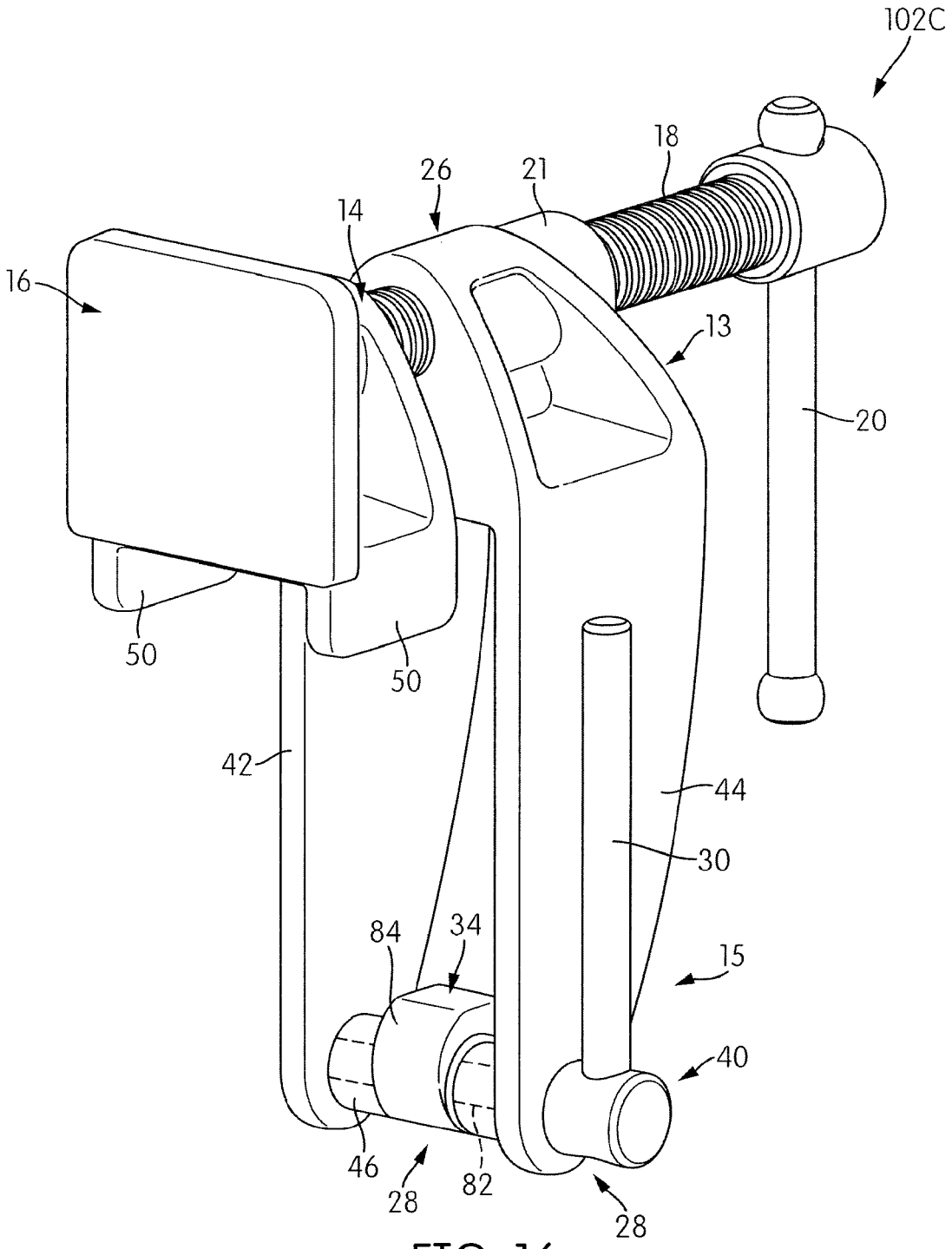
FIG. 16 illustrates a perspective view of a clamp body of FIG. 15.

FIGS. 15 and 16 show yet a further embodiment comprising a first clamp assembly 102C and a second clamp assembly 104C wherein side members 42 and 44 are integrally formed (e.g., integrally forged or molded) with the clamp mount structure 26 and/or anchored clamp head 62. In this embodiment, the first clamp assembly 102C and the second clamp assembly 104C each have a releasable connection 40 provided towards the lower portion 15 of the clamp body 12 that is constructed and arranged for attachment and release of the clamp body 12 with a 2×4. In this embodiment, handle 30 in the form of a torque bar, base 46, and a rotatable cam 84 are used to lock the clamp body 12 around the elongated structure 200. In this embodiment, base 46 takes the form of a removable and rotatable rod. For purposes of clarity and brevity, again, like elements and components in these Figures are labeled with same designations and numbering as discussed with reference to FIGS. 1-6. Thus, although not discussed entirely in detail herein, one of ordinary skill in the art should understand that various features associated with the clamp body and assembly of FIGS. 15-16 are similar to those features previously discussed.

Like the clamp bodies described above, each clamp body 12 shown in FIG. 15 has an upper portion 13 and a lower portion 15 and is configured to engage an elongated structure 200 on which the clamp assembly is to be mounted. A workpiece engaging head 14 is connected with the clamp body 12. The clamp body 12 includes a movable member 28 arranged to be moved into forced engagement with an exterior surface (e.g., bottom surface) of the elongated structure 200 to fix the clamp body on the elongated structure 200 and that is also movable away from said forced engagement to allow the clamp body to be loosened from the elongated structure 200.

The clamp assemblies 102C and 104C have at least one releasable connection 40 that is constructed and arranged to be released so that the clamp assembly can be installed on and released from the elongated structure 200 without requiring the relative clamp body to be longitudinally slid over or past an end of the elongated structure. For example, in one embodiment, the clamp assemblies 102C and 104C have a releasable connection 40 that is constructed and arranged for attachment and release of the clamp body 12 with a 2×4.

The clamp body 12 may employ portions of its side members 42 and 44 to be connected with the lower portion 15 or movable member 28. As shown, in this embodiment, the clamp body 12 will surround an elongated structure 200 when the connection 40 operates to connect the side members 42 and 44. Each bracket or side member 42 and 44 can extend substantially vertically (or substantially perpendicularly) from clamp mount structure 26 or anchored clamp head 62.

In the illustrated exemplary embodiment of FIGS. 15 and 16, releasable connection 40 includes base 46 of the movable member 28 and an internal pivot pin 82. The base 46 of movable member 28 is a part of the releasable connector that is used to connect the side members 42 and 44 of the clamp body 12. The base 46 is pivotable with respect to both of the side members 42 and 44 via movement of an internal pivot pin 82 (shown in phantom in the Figures) on lower portion 15 of the clamp body 12. Specifically, each side member 42 and 44 includes a hole (not shown) at its lower portion 15. Base 46 is configured to be inserted into and aligned in an area between the bottom portions of the side members 42 and 44. The base 46 includes a through opening extending through its body (e.g., through the rod) and a cam member 84. Its through opening is aligned with the holes of the side members 42 and 44 in order to receive internal pivot pin 82 therethrough. The pivot pin 82 is keyed to be rotationally locked to rotate the base 46. The pivot pin 82 can be held in place once placed through side members 42 and 44 and base 46 by a cotter pin. For example, as is understood by one of ordinary skill in the art, an end of the pivot pin 82 that is designed for insertion through the through holes (i.e., the end opposite to the end including handle 30)(not shown) may extend past an outer surface of a side member (e.g., side member 42) when the clamp body 12 is assembled. The extended end may include an opening (not shown) therein that is perpendicular to its rotational axis and that is configured to receive ends of a cotter pin or spring pin (or similar temporary fastener) therethrough to hold the pivot pin 82 connection with side members 42, 44, and base 46, while still allowing for relative rotation of the base 46 with respect to the side members 42 and 44. The pivot pin 82 is also part of the movable member 28. The pivot pin 82 is configured to extend substantially horizontally when assembled and forms a rotatable joint for movement of the cam member 84 of base 46 towards and away from elongate structure 200. Cam member 84 includes contact portion 34 whose flat surface can engage a surface of the elongated structure 200 as well as acts as a stop or lock when the clamp body 12 is installed. The engagement of cam member 84 with elongated structure 200 provides a force on the elongated structure 200 to secure a clamp head (26 or 62) thereto.

In an embodiment, a handle 30 is mounted on or with an end of the movable member 28 to initiate rotational movement of the base 46 and its cam member 84 for movement of the contact portion 34 into and out of engagement with elongated structure 200 between locked and unlocked positions. In an embodiment, the handle 30 is rotated upwardly to move cam member 84 into a locked position, and rotated downwardly to move cam member 84 into an unlocked position. The handle 30 can extend perpendicularly to the pivot pin 82 and base 46 of the movable member 28 when assembled. In an embodiment, handle 30 is provided in the form of a torque bar that is attached to an end of the pivot pin 82.

The illustrated features shown in FIG. 15 show handles 30 of the first and second clamp assemblies 102C and 104C provided on the same side when mounted on the elongated structure 200. Specifically, handle 30 is provided adjacent to side member 44 in first clamp assembly 102C and handle 30 is provided adjacent to side member 42 in second clamp assembly 104C. However, a handle can be mounted on either side of the clamp body 12. Accordingly, it should be understood by one of ordinary skill in the art that the location of the handle 30 when mounted with the clamp body 12 is not limiting. Because the handle 30 and pivot pin 82 are connected to the side members 42 and 44 and base 46, a user may select the configuration for insertion without departing from the scope of this disclosure.

Thus FIGS. 15 and 16 show an optional embodiment for attachment of a clamp body 12 to elongate structure 200. To attach a clamp assembly 102C to a longitudinally positioned 2×4 wood structure 200, for example, workpiece engaging head 14 is mounted on a (top) side surface of the 2×4. The side members 42 and 44 of clamp the body 12 are aligned around sides of 2×4 wood structure 200. The base 46 is inserted between the bottom ends of the side members 42 and 44 and their holes are aligned. Its cam member 84 is positioned facing away (e.g., towards the floor) from a side of the elongated structure 200. The pivot pin 82 of the movable member 28 is inserted through the aligned holes of the side member 44, base 46, and side member 42 (or vice versa, i.e., through side member 42, base 46, and side member 44). The pivot pin 82 is secured to the clamp body 12 via a cotter pin or other fastener. Handle 30 is rotated about its axis, as shown by arrow L in FIG. 15, to move the cam member 84 of base 46 rotatably upwardly towards a bottom side of elongated structure 200. For example, handle 30 can be rotated from a lower position (e.g., see clamp assembly 104C in FIG. 15) towards upper portion 13 of the clamp body 12 (e.g., see clamp assembly 102C in FIG. 15 and FIG. 16) to engage the elongated structure 200 and lock the clamp body 12. As the movable member 28 is rotated, contact portion 34 is moved into forced engagement with (bottom) exterior surface of wood structure 200, thereby securing the clamp assembly 102C to the 2×4.

Conversely, the method of releasing and removing the clamp assembly from an elongated structure 200 (2×4) includes steps that are substantially opposite to those described and above. To release the clamp assembly 102C, for example, the method of removal starts by loosening the movable member 28 of the clamp body 12 away from said forced engagement with the bottom side surface of the wood structure 200 by turning handle 30 rotationally (e.g., in a downward direction). The contact portion 34 of cam member 84 of base 46 is released from contact and the cam member 84 is moved rotatably downwardly, for example. Then, the clamp body 12 is released from engagement with the elongated structure 200. The cotter pin or fastener is removed from the end of the pivot pin 82. The pivot pin 82 can then be pulled from the side members 42 and 44 and base 46. The base 46 is removed from the area between the side members 42 and 44. The head 14 and side members 42, 44 can be lifted to release the clamp body 12 (e.g., in a vertical or Y-direction) from engagement with the top side of the wood structure 200.

Accordingly, the clamp body 12 of FIGS. 15 and 16 is released from the wood structure 200 without requiring the clamp body 12 to be longitudinally slid past an end thereof.

Figure 17:
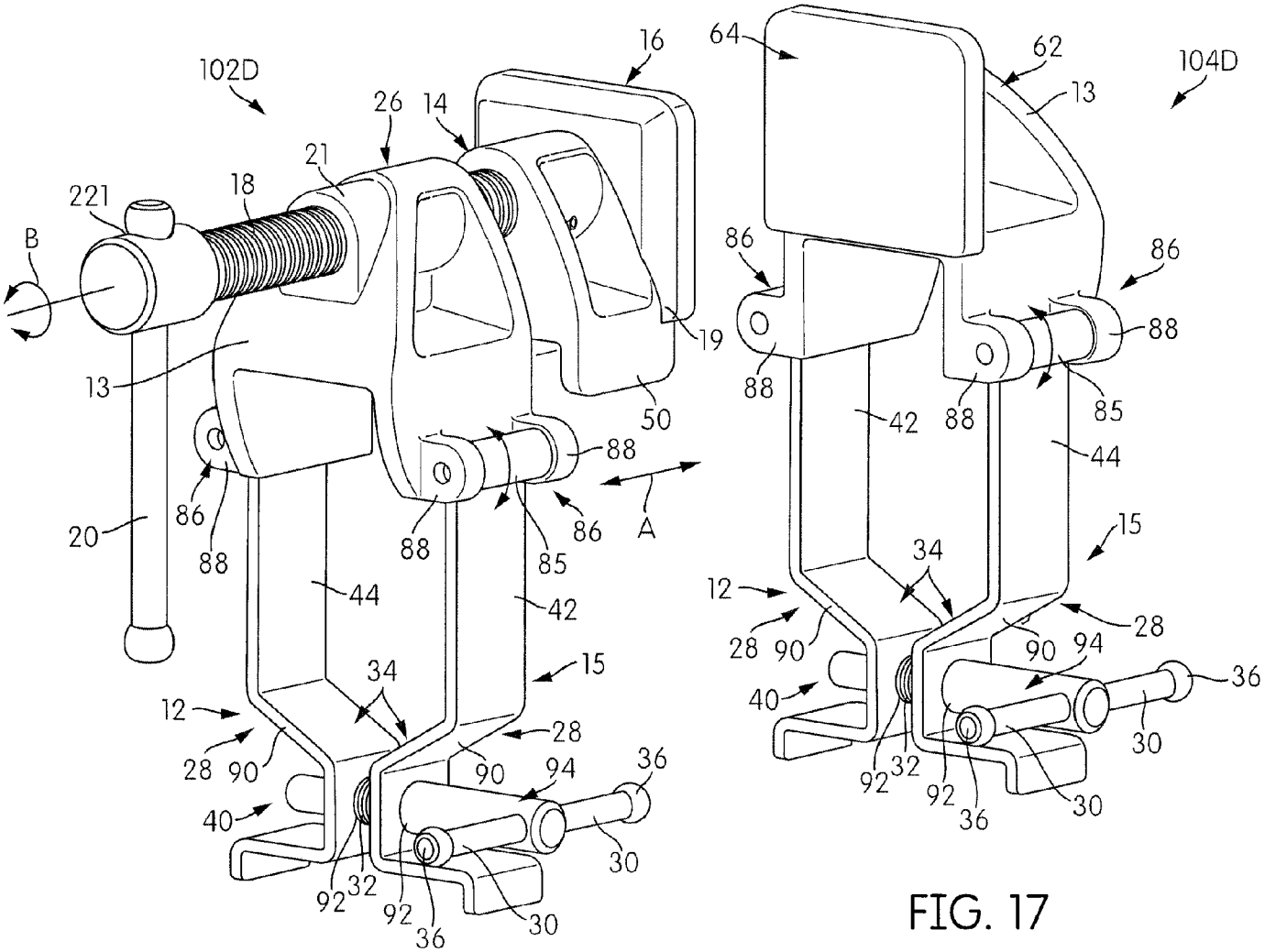
FIG. 17 illustrates a perspective view of a clamp assembly pair in accordance with another embodiment of this disclosure.

In accordance with another embodiment, FIG. 17 illustrates a perspective view of alternate clamp assemblies 102D and 104D each with a clamp body. For purposes of clarity and brevity, as noted above, like elements and components in FIG. 17 are labeled with same designations and numbering as discussed with reference to FIGS. 1-6. Thus, although not discussed entirely in detail herein, one of ordinary skill in the art should understand that various features associated with the clamp body and assembly of FIG. 17 are similar to those features previously discussed.

Like the clamp bodies described above, clamp body 12 shown in FIG. 17 has an upper portion 13 and a lower portion 15 and is configured to engage an elongated structure 200 on which the clamp assembly is to be mounted. A workpiece engaging head 14 is connected with the clamp body 12. The clamp body 12 includes a movable member 28 arranged to be moved into forced engagement with an exterior surface (e.g., bottom surface) of the elongated structure 200 to fix the clamp body on the elongated structure 200 and that is also movable away from said forced engagement to allow the clamp body to be loosened from the elongated structure 200.

The clamp assemblies 102D and 104D each have at least one releasable connection that is constructed and arranged to be released so that the clamp assembly can be installed on and released from the elongated structure 200 without requiring the relative clamp body to be longitudinally slid over or past an end of the elongated structure. For example, in one embodiment, and as will be described in greater detail later, the clamp assemblies 102D and 104D have a releasable connection 40 that is constructed and arranged for attachment and release of the clamp body 12 with a 2×4.

In an embodiment, the releasable connection is provided between upper portion 13 and lower portion 15 of the clamp body 12. For example, in one embodiment, the releasable connection can be provided anywhere between its head 14 and the movable member 28 (and its associated lower portion 15).

In one embodiment, the releasable connection 40 is provided towards the lower portion 15 of the clamp body 12. For example, the clamp body 12 may employ portions of its side members 42 and 44 to be connected to secure the clamp body 12 to the elongated structure 200. As shown, in this embodiment, the clamp body 12 will surround an elongated structure 200 when the connection 40 operates to connect the lower portions 15 of the side members 42 and 44. In the illustrated exemplary embodiment of FIG. 17, the brackets or side members 42 and 44 of body 12 may also be considered or viewed as a first connector 42 and second connector 44 as well as the movable member 28. Each bracket or side member 42 and 44 can extend substantially vertically (or substantially perpendicularly) from its head.

In various embodiments, one or both of the side members 42, 44 are pivotable with respect to their head 26 or 62 on upper portion 13 of the clamp body 12. FIG. 17 shows an example of both of the side members 42 and 44 being pivotally connected to their heads 26 and 62. The clamp mount structure 26 and anchored clamp head 62 include pivot hinge connections 86 on either of its sides for pivotal connection with side members 42 and 44. Specifically, a portion of each side member 42 and 44 is formed into a curved structure 85 configured for connection with arms 88 extending from clamp mount structure 26 or anchored clamp head 62. The curved structure 85 can freely pivot within arms 88 and rotate relative to the heads 26 or 62.

At least one of the side members 42 and 44 has a connector portion that is engagable and disengagable. Side members 42 and 44 can be configured for connection and disconnection with each other, for example. In one embodiment, the side members 42 and 44 are provided in the form of brackets that each have angled surfaces 90 at a lower portion 15 of the clamp body 12 and receiving holes 92 for releasable connection of a lock bar 94. The angled surfaces 90 are provided to wedge against the elongated structure 200 when the clamp body 12 is locked thereon. The receiving holes 92 are provided on straight portions below the angled surfaces 90 and are configured to receive at least a portion of lock bar 94. The receiving holes 92 can have threads therein and lock bar 94 can be a threaded bar with screw threads, for example. A handle 30 can be attached to the lock bar 94 for its rotation. The threaded lock bar 94 can be attached through the holes 92 of the straight portions of the side members 42 and 44 and secured with a nut, for example. As the threaded lock bar 94 is tightened, the lower portions of side members 42 and 44 can be moved towards each other such that angled surfaces 90 are also moved into engagement with surfaces (side corners) of elongated structure 200. Movement of the angled surfaces 90 into engagement with the surfaces of the elongated structure 200 provides pressure to the clamp body 12 and secure its head 26 or 62 thereon. Accordingly, each of the angled surfaces 90 act in combination as a movable member that is movable away from and into forced engagement to allow for loosening or tightening of the clamp body with the elongated structure 200.

The illustrated features shown in FIG. 17 show handles 30 of the first and second clamp assemblies 102D and 104D provided on the same side for mounting on the elongated structure 200. Specifically, handle 30 is provided adjacent to side member 44 in first clamp assembly 102C and handle 30 is provided adjacent to side member 42 in second clamp assembly 104C. However, a handle can be mounted on either side of the clamp body 12. Accordingly, it should be understood by one of ordinary skill in the art that the location of the handle 30 when mounted with the clamp body 12 is not limiting. Because the handle 30 and threaded lock bar 94 are connected to the side members 42 and 44, a user may select the configuration for insertion without departing from the scope of this disclosure.

Thus FIG. 17 shows an optional embodiment that can include pivotal attachment of a clamp body 12 to elongate structure 200. To attach a clamp assembly 102D to a longitudinally positioned 2×4 wood structure 200, for example, workpiece engaging head 14 is mounted on a (top) side surface of the 2×4. The side members 42 and 44 of clamp the body 12 are aligned around sides of 2×4 wood structure 200 by rotating each about their pivot hinge connections 86 in a substantially downward direction towards the lower portion 15. The curved structure 85 of each side members 42, 44 is rotated relative to arms 88 of the clamp mounting structure 26 such that the receiving holes 92 of the side members 42 and 44 are substantially parallel to each other. The lock bar 94 is guided for receipt within aligned receiving holes 92 of the straight portions of side members 42 and 44, and a nut it attached to an end of the lock bar 94. The lock bar 94 is tightened and moves side members 42 and 44 closer together. Accordingly the movable member 28 of the clamp body 12, i.e., the angled surfaces 90 of each side member 42 and 44, is moved into contact with the exterior surface (side corners) of the 2×4. Specifically, handle 30 is rotated about its axis (e.g., in a clockwise direction) which in turn moves and tightens the screw threads of lock bar 94. As the lock bar 94 is rotated, angled surfaces 90 of side members 42 and 44 are is moved in a relative (substantially horizontal) direction towards each other and into engagement with the opposite exterior surfaces (corners) of wood structure 200, thereby securing the clamp assembly 102D to the 2×4.

Accordingly, it should also be understood be one of ordinary skill in the art, then, that, optionally, a method of releasing the releasable connection may further include pivoting the releasable connection away from the elongated structure. For example, to release the clamp assembly 102D, the method of removal starts by removing the nut and turning the handle 30 rotationally in an opposite direction (e.g., in a counter-clockwise direction) to rotate the lock bar 94 such that the angled surfaces 90 of the movable member 28 of the clamp body 12 are moved relatively away from each other and from said forced engagement with the exterior surfaces (side corners) of the wood structure 200. Once the lock bar 94 is unscrewed from the side members 42 and 44, and removed from engagement therewith, the side members 42 and 44 of the clamp body 12 are then unattached from the elongated structured 200 by lifting and pivoting each side member towards the upper portion 13 about the pivot hinge connections 86. Then, the clamp body 12 is released from engagement with the head 14. The workpiece engaging head 14 can be lifted (e.g., in a vertical or Y-direction) to release any engagement with the top side of the wood structure 200. Accordingly, the clamp body 12 of FIG. 17 is released from the wood structure 200 without requiring the clamp body 12 to be longitudinally slid past an end thereof.

Figure 20:
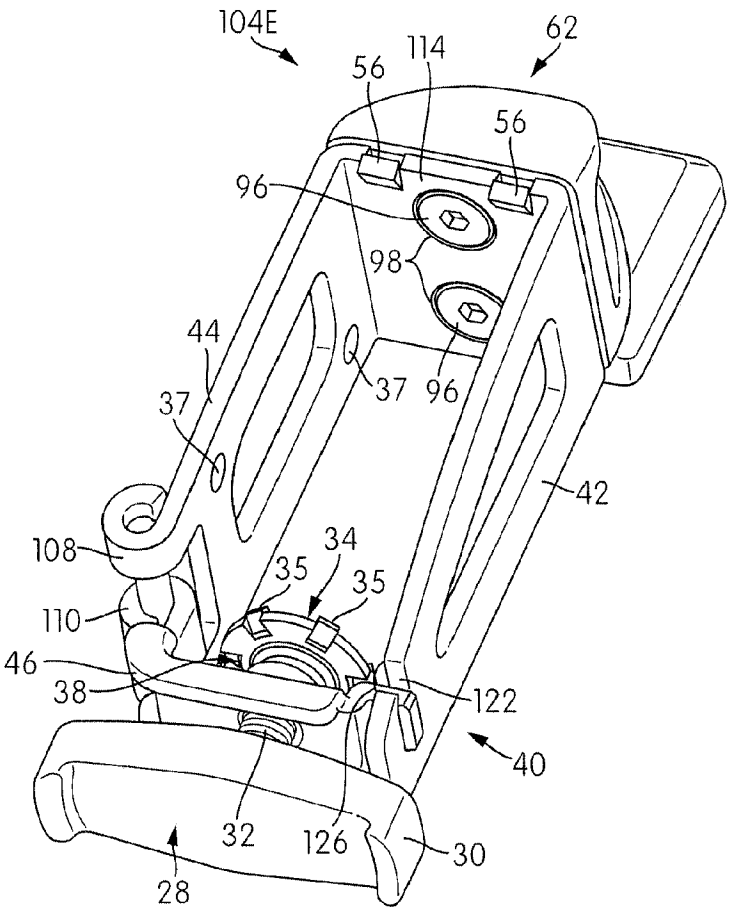
FIG. 20 illustrates an underside perspective view of a clamp body of FIG. 19.

FIGS. 18-21 show still yet another embodiment comprising a first clamp assembly 102E and a second clamp assembly 104E wherein side members 42 and 44 are connected to the clamp mount structure 26 and/or anchored clamp head 62, in accordance with an embodiment. As shown in FIG. 20, for example, the side members 42 and 44 may be integrally formed with a horizontal base member 114 (e.g., integrally forged or molded) that is configured to be attached to a clamp head (e.g., anchored clamp head 26). Base member 114 includes openings 98 therein for receipt of fasteners (e.g., bolts). The fasteners are inserted through the openings 98 to connect the base member 114 and side members 42 and 44 to the clamp head.

Further, in this embodiment, the first clamp assembly 102E and the second clamp assembly 104E each have a releasable connection 40 provided towards the lower portion 15 of the clamp body 12 that is constructed and arranged for attachment and release of the clamp body 12 with a 2×4. For purposes of clarity and brevity, like elements and components in FIGS. 18-21 are labeled with same designations and numbering as discussed with reference to FIGS. 1-6. Thus, although not discussed entirely in detail herein, one of ordinary skill in the art should understand that various features associated with the clamp body and assembly of FIGS. 18-21 are similar to those features previously discussed.

Like the clamp bodies described above, each clamp body 12 shown in FIG. 18 has an upper portion 13 and a lower portion 15 and is configured to engage an elongated structure 200 on which the clamp assembly is to be mounted. A workpiece engaging head 14 is connected with the clamp body 12. The clamp body 12 includes a movable member 28 arranged to be moved into forced engagement with an exterior surface (e.g., bottom surface) of the elongated structure 200 to fix the clamp body on the elongated structure 200 and that is also movable away from said forced engagement to allow the clamp body to be loosened from the elongated structure 200.

The clamp assemblies 102E and 104E have at least one releasable connection that is constructed and arranged to be released so that the clamp assembly can be installed on and released from the elongated structure 200 without requiring the relative clamp body to be longitudinally slid over or past an end of the elongated structure. For example, in one embodiment, the clamp assemblies 102E and 104E have a releasable connection 40 that is constructed and arranged for attachment and release of the clamp body 12 with a 2×4.

Figure 18:
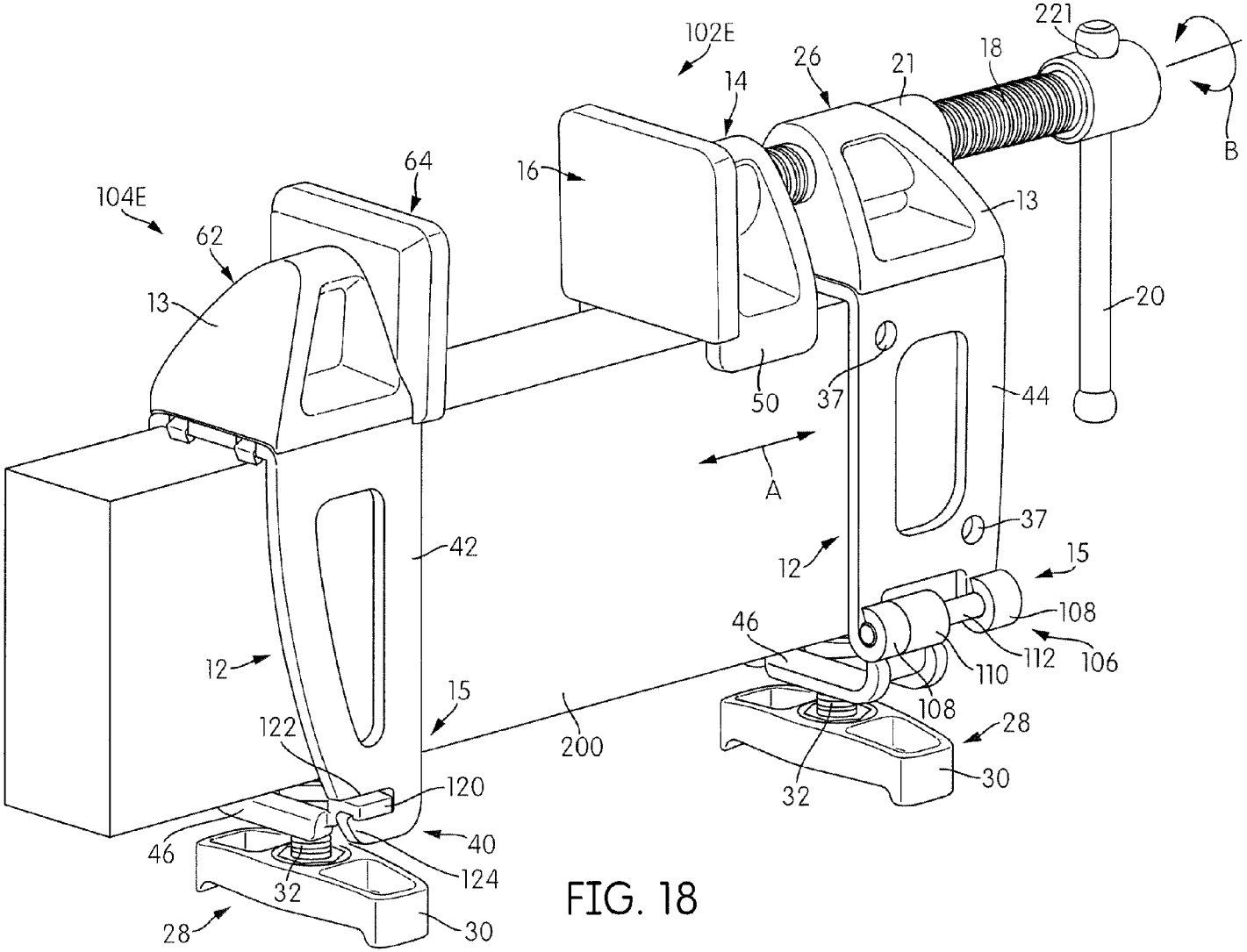
FIG. 18 illustrates a perspective view of a clamp assembly pair in accordance with still yet another embodiment of this disclosure.

The releasable connection 40 is provided towards the lower portion 15 of the clamp body 12 and can be used to connect the upper portion 13 and lower portion 15. For example, the clamp body 12 may employ portions of its side members 42 and 44 to be removably connected with a base 46. As shown in FIG. 18, in this embodiment, the clamp body 12 will surround an elongated structure 200 when the connection 40 operates to connect the upper and lower portions 13, 15. The brackets or side members 42 and 44 of body 12 may also be considered or viewed as a first connector 42 and second connector 44 to connect the movable member 28 and base 46 to the workpiece engaging head 14. Each bracket or side member 42 and 44 can extend substantially vertically (or substantially perpendicularly) from base 46.

Figure 19:
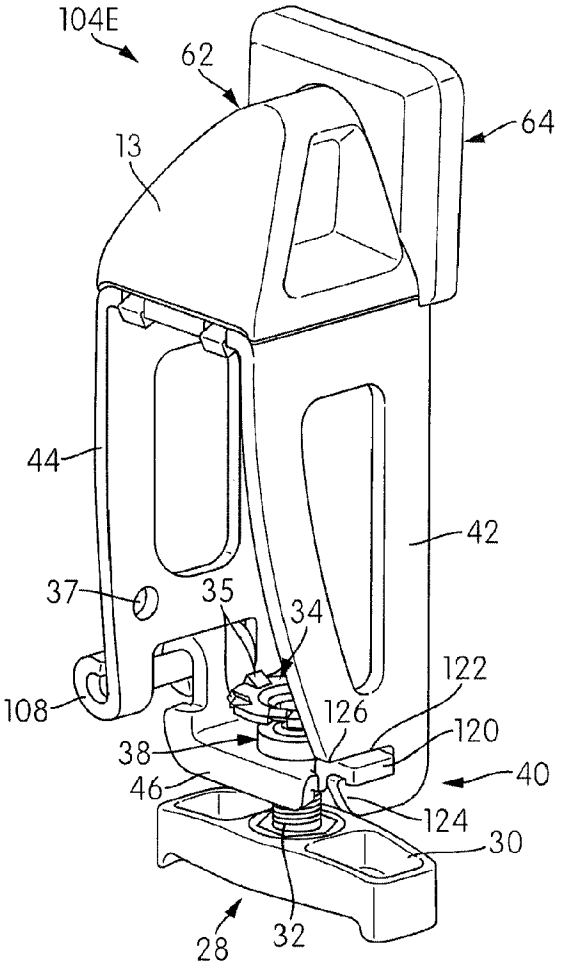
FIG. 19 illustrates a perspective view of a clamp body of FIG. 18.

The base 46 is pivotable with respect to one of the side members 42 or 44 via pivot hinge 106 on lower portion 15 of the clamp body 12. FIGS. 19 and 20 show an example of base 46 in the form of a releasable latch portion configured to releasably connect with a receiving opening 122. Specifically, in this exemplary illustration, one end 120 of the latch portion of base 46 is pivotally connected to side member 44, while the other end is a connection end configured for alignment with and receipt in receiving opening 122 of side member 42. The receiving opening 122 includes a flange 124 configured to hold at least a bottom portion of the connection end 120 within the receiving opening 122. However, it should also be understood to one of ordinary skill in the art that the illustration is exemplary only, and that, in accordance with one embodiment, base 46 may be configured to be pivotally connected to side member 42, and receiving opening 122 within side member 44. Accordingly, the features described in greater detail below with regard to second clamp assembly 104E in FIGS. 19-21 are not limiting.

Figure 21:
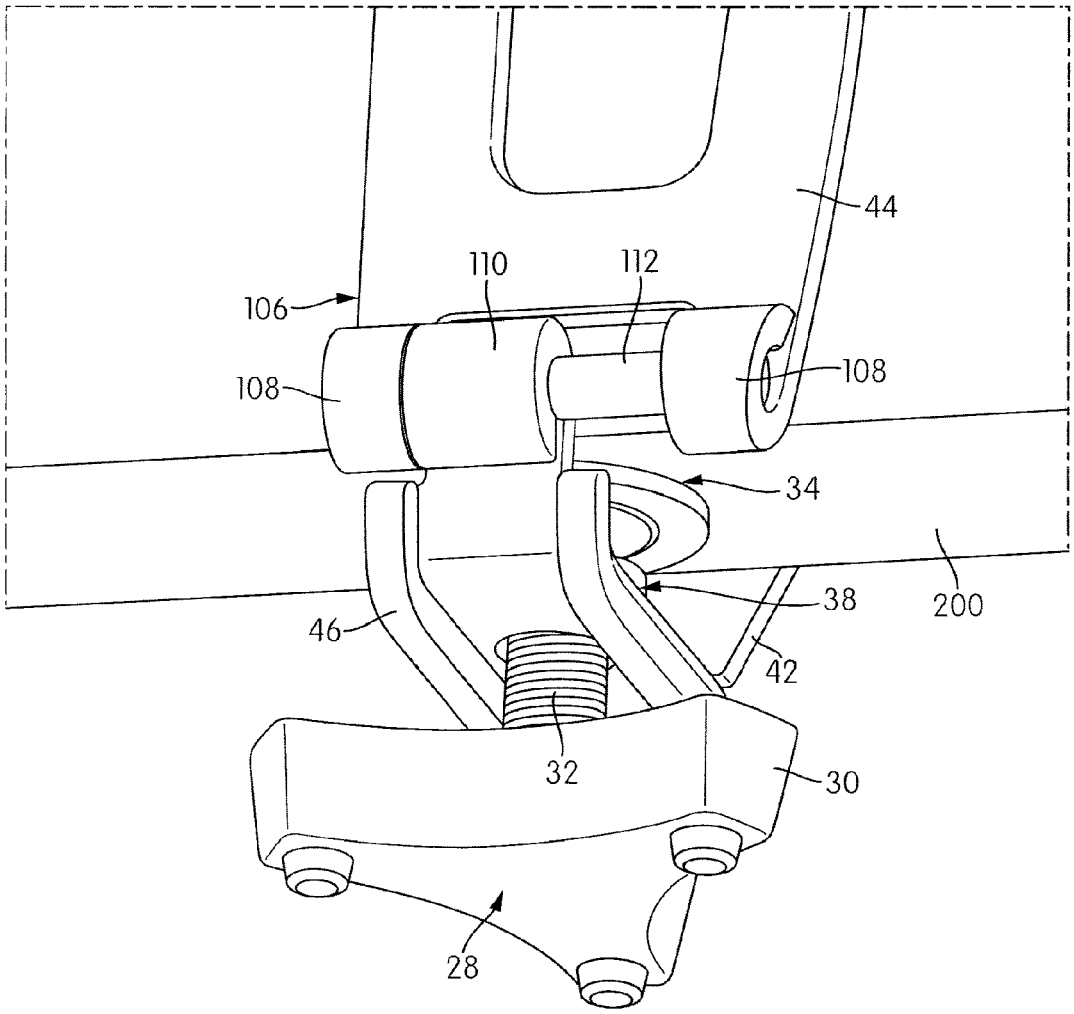
FIG. 21 illustrates a detailed, underside perspective view of a movable member of a clamp assembly of FIG. 18 in accordance with an embodiment of this disclosure.

As shown in greater detail in FIG. 21, the other end of base 46 has a curved portion 110 that is connected to curved ends 108 of side member 44 via a pivot pin 112. This forms the pivot hinge connection 106 and thus a rotatable joint for movement of the base 46 towards and away from elongate structure 200. The base 46 of clamp body 12 is configured for pivotal relation relative to the side member 44. Moreover, the base 46 is configured to move horizontally along pivot pin 112. That is, curved portion 110 of base 46 is configured for movement between curved ends 108 of side member 44 to allow for movement of connection end 120 into and out of receiving opening 122 on side member 42, which is described in greater detail below.

Base 46 further includes a through hole portion 38 through which first movable member 28 extends. First movable member 28 has screw threads 32 that cooperate with corresponding threads in through hole portion 38 so that contact portion 34 is moved into or out of engagement with the 2×4. In an embodiment, a handle 30 is mounted on or with another end of first movable member 28 to initiate rotational movement thereof and movement of contact portion 34. In one embodiment, contact portion 34 can include a plurality of extended engagement portions or teeth 35 configured for contact with elongated structure 200.

As previously noted, the opposite end of base 46 is a connection end 120 configured to be releasably captured and at least temporarily secured within receiving opening 122 of side member 42. More specifically, the connection end 120 of the base 46 acts as a connector portion that is engagable and disengagable with side member 42. The connection end 120 is configured to be received within receiving opening 122 via an open end 126 and at least temporarily held therein by flange 124. Flange 124 is provided to retain at least a lower and side edge of the connection end 120 of base 46 within receiving opening 122 when the end 120 is connected to side member 42. In an embodiment, the flange 124 is configured to assist in maintaining connection of side members 42 and 44 with the base 46. Once upper portion 13 is provided on the elongated structure 200, the base 46 can be pivoted upwardly towards upper portion 13. The curved portion 110 of base 46 is configured to rotate about pivot pin 112 and connection end 120 is inserted into receiving opening 122 of side member 42. The movable member 28 is then tightened as previously described.

Thus FIGS. 18-21 show an optional embodiment that can include pivotal attachment of a clamp body 12 to elongate structure 200. To attach a clamp assembly 104E to a longitudinally positioned 2×4 wood structure 200, for example, workpiece engaging head 14 is mounted on a (top) side surface of the 2×4. The side members 42 and 44 of clamp the body 12 are aligned around sides of 2×4 wood structure 200. The base 46 can be rotated about its pivot hinge connection 106 for alignment with receiving opening 122 on side member 42 by rotating it in a substantially upward direction, towards a bottom side of the elongated structure 200. The connection end 120 of base 46 is aligned with open end 126 of the receiving opening 122 and the base 46 is moved horizontally via its curved portion 110 along pivot pin 112 and into receiving opening 122. Once the connection end 120 is received within receiving opening 122, it is held by flange 124. Then the movable member 28 is moved into contact with the (bottom) exterior surface of the 2×4. Specifically, handle 30 is rotated about its axis (e.g., in a clockwise direction) which in turn moves the screw threads 32 of movable member 28 through through hole portion 38. As the movable member 28 is rotated using screw threads 32, it is moved in a vertical direction into engagement with (bottom) exterior surface of wood structure 200, thereby securing the clamp assembly 102A to the 2×4.

Accordingly, it should also be understood be one of ordinary skill in the art, then, that, optionally, a method of releasing the releasable connection 40 may further include pivoting the releasable connection (e.g., base 46) away from the elongated structure. For example, to release the clamp assembly 104E, the method of removal starts by moving the movable member 28 of the clamp body 12 away from said forced engagement with the bottom exterior surface of the wood structure 200 by turning handle 30 rotationally (e.g., in a counter-clockwise direction). The connection end 120 of the base 46 can then be moved out of receiving opening 122 of side member 42 by lifting the end 120 over flange 124 and moving base 46 horizontally along pivot pin 110 and out of the open end 126 of the receiving opening 122. The base 46 is then pivoted about its pivot hinge connection 106 away from the side member 42. Then, the clamp body 12 is released from engagement with the elongated structure 200. The head 62 and side members 42, 44 can be lifted to release the clamp body 12 (e.g., in a vertical or Y-direction) from engagement with the top side of the wood structure 200. Accordingly, the clamp body 12 of FIGS. 18-21 is released from the wood structure 200 without requiring the clamp body 12 to be longitudinally slid past an end thereof.

The structure of base 46 and side members 42 and 44 in any of the embodiments described with respect to FIGS. 10-21 can be manufactured via stamping, forging, and/or threading processes, for example.

In accordance with various embodiments as disclosed herein, the base or bottom member 46 of the clamp body 12 (or attached to the clamp body 12) may itself operate as the movable member 28 that is forced into engagement with an exterior (or side) surface of the elongated structure 200. In other embodiments described herein, the movable member 28 is separate from the base member 46 and movable relative to the base member 46 into engagement with the exterior surfaces of the elongated structure 200.

While the features of the disclosure have been made clear in the illustrative embodiments set forth above, it will be apparent to those skilled in the art that various modifications may be made to the structure, arrangement, proportion, elements, materials, and components used in the practice of the disclosure.

It will be realized, however, that the foregoing preferred specific embodiments have been shown and described for the purpose of illustrating the functional and structural principles of this disclosure and are subject to change without departure from such principles. Therefore, this invention includes all modifications encompassed within the spirit and scope of the following claims.

What is claimed is:

1. A clamp assembly pair for clamping onto an elongated structure including upper and lower surfaces, comprising:

a first clamp assembly for clamping a first workpiece engaging head onto the elongated structure, including a first clamp body configured to engage the elongated structure, the first clamp body configured to surround the elongated structure and including a first set of upper and lower surfaces, the first workpiece engaging head configured to be movable with respect to the first clamp body during a clamping operation, the first workpiece engaging head including a first workpiece engaging structure configured to apply a longitudinal force to a workpiece, the longitudinal force being in a direction corresponding to a longitudinal direction of the elongated structure, and a first movable member being movable to reduce a distance between the first set of upper and lower surfaces of the clamp body so that the clamp body is moved into forced engagement with the upper and lower surfaces of the elongated structure to fix the first clamp body on the elongated structure, the first movable member being movable to increase the distance between the first set of upper and lower surfaces of the clamp body so as to release said forced engagement and allow the first clamp body to be loosened from the elongated structure;

a second clamp assembly for clamping a second workpiece engaging head onto the elongated structure, including a second clamp body configured to engage the elongated structure, the second clamp body configured to surround the elongated structure and including a second set of upper and lower surfaces, the second workpiece engaging head being operatively connected with respect to the second clamp body during a clamping operation, the second workpiece engaging head including a second workpiece engaging structure configured to apply a longitudinal force to the workpiece, the longitudinal force being in the direction corresponding to the longitudinal direction of the elongated structure, and a second movable member being movable to reduce a distance between the second set of upper and lower surfaces of the clamp body so that the clamp body is moved into forced engagement with the upper and lower surfaces of the elongated structure to fix the second clamp body on the elongated structure, the second movable member being movable to increase the distance between the second set of upper and lower surfaces so as to release said forced engagement and allow the second clamp body to be loosened from the elongated structure, wherein the first clamp body and the second clamp body comprises a releasable connection constructed and arranged to be released so that the first clamp assembly and the second clamp assembly can be installed on and released from the elongated structure without requiring the associated clamp body to be longitudinally slid past an end of the elongated structure.

2. The clamp assembly pair according to claim 1, where in the second workpiece engaging head is fixed relative to the second clamp body during a clamping operation.

3. The clamp assembly pair according to claim 1, wherein the releasable connection of each of the first clamp body and the second clamp body connects the first and second clamp bodies to their respective first and second workpiece engaging heads.

4. The clamp assembly pair according to claim 1, wherein the releasable connection of each of the first clamp body and the second clamp body disconnects portions of the first and second clamp bodies to enable the first and second clamp bodies to be installed on or removed from the elongated structure.

5. The clamp assembly pair according to claim 1, wherein at least a portion of the releasable connection of each of the first clamp body and the second clamp body is configured for pivotal movement away from the elongated structure when released.

6. The clamp assembly pair according to claim 1, wherein each of the first clamp body and the second clamp body defines a space configured to receive a rectangular elongated structure therein.

7. The clamp assembly pair according to claim 6, wherein each of the first clamp body and the second clamp body that defines the space comprises the space being provided between the upper and lower surfaces of the respective clamp bodies that are configured to engage the upper and lower surfaces of the elongated structure.

8. The clamp assembly pair according to claim 1, wherein one of the upper and lower surfaces of each of the first clamp body and the second clamp body is on the respective first and second movable members.

9. The clamp assembly pair according to claim 1, wherein the upper and lower surfaces of each of the first clamp body and the second clamp body apply a clamping force to the elongated structure upon application of the longitudinal force by the workpiece engaging structure, wherein the clamping force resists longitudinal movement of each of the first clamp body and the second clamp body along the elongated structure during application of the longitudinal force.

10. The clamp assembly pair according to claim 1, wherein the releasable connection of at least one of the first clamp body and the second clamp body connects the respective clamp body to its workpiece engaging head.

11. The clamp assembly pair according to claim 1, wherein the releasable connection at least one of the first clamp body and the second clamp body disconnects a portion of the respective clamp body to enable the respective clamp body to be installed on or removed from the elongated structure.

12. The clamp assembly pair according to claim 1, wherein at least one of the first clamp body and the second clamp body comprises an upper portion and a lower portion, and wherein the releasable connection for the respective clamp body is between the upper portion and the lower portion.

13. The clamp assembly pair according to claim 1, wherein the first workpiece engaging head, the second workpiece engaging head, or both, is movably adjustable relative to the clamp body by a rotatable screw.

14. The clamp assembly pair according to claim 1, wherein the first workpiece engaging head, the second workpiece engaging head, or both, is integrally formed as a part of the clamp body.

15. The clamp assembly pair according to claim 1, wherein at least a portion of the releasable connection of at least one of the first clamp body and the second clamp body is configured for pivotal movement away from the elongated structure when released.

16. The clamp assembly pair according to claim 1, wherein the elongated structure that which the first clamp body and the second clamp body are configured to engage is a 2×4 wood structure.

* * * * *